US010118388B2

(12) United States Patent
Barbet et al.

(10) Patent No.: US 10,118,388 B2
(45) Date of Patent: Nov. 6, 2018

(54) STURDY DROP GENERATOR

(71) Applicant: MARKEM-IMAJE HOLDING, Bourg-les-valence (FR)

(72) Inventors: Bruno Barbet, Etoile-sur-Rhone (FR); Pierre De Saint Romain, Valence (FR)

(73) Assignee: MARKEM-IMAJE HOLDING, Bourg-les-Valence (FR)

( * ) Notice: Subject to any disclaimer, the term of this patent is extended or adjusted under 35 U.S.C. 154(b) by 0 days.

(21) Appl. No.: 15/800,403

(22) Filed: Nov. 1, 2017

(65) Prior Publication Data

US 2018/0065363 A1 Mar. 8, 2018

Related U.S. Application Data

(63) Continuation of application No. 15/302,734, filed as application No. PCT/EP2015/057612 on Apr. 8, 2015, now Pat. No. 9,844,936.

(30) Foreign Application Priority Data

Apr. 8, 2014 (FR) ..... 14 53134

(51) Int. Cl.
*B41J 2/14* (2006.01)
*B41J 2/025* (2006.01)
*B41J 2/02* (2006.01)

(52) U.S. Cl.
CPC ..... *B41J 2/14008* (2013.01); *B41J 2/02* (2013.01); *B41J 2/025* (2013.01); *B41J 2/14201* (2013.01)

(58) Field of Classification Search
CPC . B41J 2/14008; B41J 2/02; B41J 2/025; B41J 2/14201; B41J 2002/02; B41J 2002/022
See application file for complete search history.

(56) References Cited

U.S. PATENT DOCUMENTS 5,063,393 A * 11/1991 Clark ..... B41J 2/02 29/890.1
6,802,599 B1 * 10/2004 Pannu ..... B41J 2/025 347/73

(Continued)

FOREIGN PATENT DOCUMENTS

JP S58-3874 A 1/1983
JP 2005-081643 A 3/2005

(Continued)

OTHER PUBLICATIONS

French Search Report issued in Patent Application No. FR 1453134 dated Feb. 6, 2015.

(Continued)

*Primary Examiner* — Juanita D Jackson
(74) *Attorney, Agent, or Firm* — Pearne & Gordon LLP

(57) ABSTRACT

A device for forming and ejecting drops of an ink jet of a CIJ printing machine, this device including: a cavity for containing an ink and including an end provided with a nozzle (10) for ejecting ink drops, actuator means (21, 22, 32, 41, 42), in contact with the cavity, in which device the jet velocity modulation, from the nozzle (10), has a value $\Delta Vj(f_t)$ at the operating frequency of the cavity and the actuator, and this jet velocity modulation, at the temperature of 15° C. and at the temperature of 35° C., does not vary, in a frequency range of ±5 kHz about the operating frequency $f_t$, outside the range of between $0.25\Delta Vj(f_t)$ and $4\Delta Vj(f_t)$.

8 Claims, 17 Drawing Sheets

(56) References Cited

U.S. PATENT DOCUMENTS

| | | | |
|---|---|---|---|
| 8,162,450 | B2 | 4/2012 | Barbet |
| 8,540,350 | B2 | 9/2013 | Barbet |
| 9,028,024 | B2 | 5/2015 | Barbet et al. |
| 2012/0182362 | A1 | 7/2012 | Odin |
| 2014/0049580 | A1 | 2/2014 | Odin |
| 2014/0050868 | A1 | 2/2014 | De Saint-Romain |
| 2014/0065381 | A1 | 3/2014 | De Saint Romain et al. |
| 2015/0368486 | A1 | 12/2015 | De Saint-Romain |
| 2016/0067962 | A1 | 3/2016 | De Saint Romain |
| 2016/0075897 | A1 | 3/2016 | Barbet et al. |
| 2016/0082746 | A1 | 3/2016 | De Saint Romain |
| 2016/0289473 | A1 | 10/2016 | De Saint Romain |

FOREIGN PATENT DOCUMENTS

| | | | |
|---|---|---|---|
| JP | 2006-076039 | A | 3/2006 |
| WO | 2011/012641 | A1 | 2/2011 |
| WO | 2012/107560 | A1 | 8/2012 |

OTHER PUBLICATIONS

International Preliminary Report on Patentability issued in Patent Application No. PCT/EP2015/057612 dated Jul. 7, 2016.
International Search Report issued in Patent Application No. PCT/EP2015/057612 dated Jun. 10, 2015.
Written Opinion issued in Patent Application No. PCT/EP2015/057612 dated Jun. 10, 2015.
First Office Action issued in Chinese Patent Application No. 201580018654 dated Aug. 9, 2017.

* cited by examiner

FIG.3a
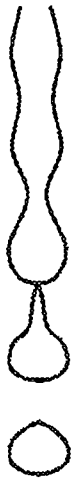
FIG.3b
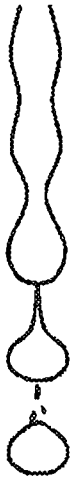
FIG.3c
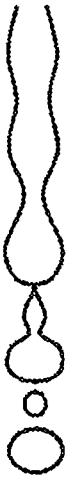
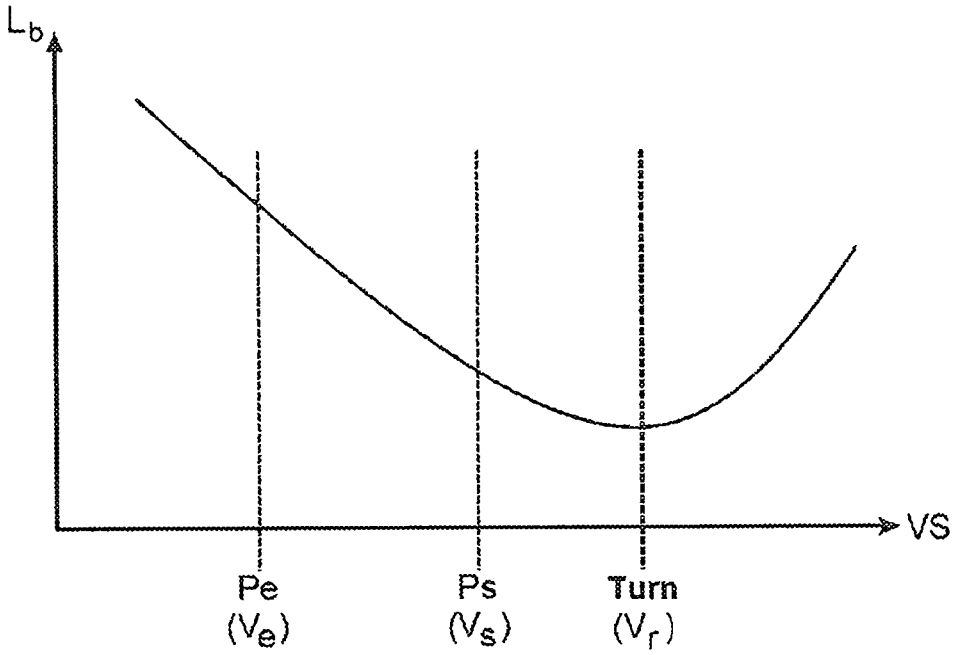
FIG.4

STURDY DROP GENERATOR

TECHNICAL FIELD AND STATE OF PRIOR ART

The invention relates to the improvement of the operation of a printing head of a CIJ printer to make it sturdier towards environmental variations (in particular temperature) found on industrial use of this type of printer.

This improvement involves an increase in the sturdiness of the stimulation function of the drop generator towards temperature.

Continuous ink jet (CIJ) printers are well known in the field of coding and industrial labelling for various products, for example to label bar codes or the expiration date on food products directly on the production line and at a high rate. This type of printer also founds application in the decorative field where graphic printing possibilities of the technology are exploited.

CIJ printers continuously generate drop jets some of which are selected and oriented to the support to be printed whereas the others are recovered to be recycled. These printers have some standard sub-assemblies as shown in FIG. 1.

First, a printing head 1, generally offset from the body of the printer 3, is connected thereto by a flexible umbilical 2 joining the hydraulic and electrical connections required for operating the head by providing it with flexibility which facilitates integration on the production line.

The body of the printer 3 (also called a console or cabinet) usually contains three sub-assemblies:

- an ink circuit 4 at the lower part of the console (zone 4'), the main purpose of which is, on the one hand, to provide ink to the head at a stable pressure and with a suitable quality, and on the other hand, to accommodate the jet ink not used for printing;
- a controller 5 located at the upper part of the console (zone 5'), capable of managing the action sequencing and performing processes enabling different functions of the ink circuit and of the head to be activated;
- an interface 6 which gives the operator means for implementing the printer and for informing about its operation.

This description can be applied to continuous jet (CIJ) printers called binary printers or multi-deflected continuous jet printers.

Binary CIJ printers are equipped with a head the drop generator of which has a multitude of jets the drops of which can only be oriented to 2 trajectories: printing trajectory or recover trajectory.

In multi-deflected continuous jet printers, each drop of a single jet (or spaced apart from a few jets) can be deflected on various trajectories corresponding to different commands. A succession of drops undergoing different commands can thus scan the zone to be printed along a direction which is the deflection direction, the other scanning direction of the zone to be printed is covered by a relative movement of the printing head and the support to be printed 8. Generally, the elements are arranged such that these 2 directions are substantially perpendicular.

The deviated continuous ink jet printing heads have different operating sub-assemblies. FIG. 2 depicts in particular a printing head of a multi-deflected CIJ printer. It consists of:

- means 10, 63 for generating a drop jet called drop generator or stimulation body;
- means 62 for recovering ink not used for printing;

- means 65 for deflecting drops for printing;
- means for monitoring and controlling the drop deflection process (synchronisation of drop formation with deflection commands).

Referring to FIG. 2 which depicts a multi-deflected CIJ printing head, there is a drop generator 60 in which a cavity is supplied with an electrically conductive ink. This ink, held under pressure, by the ink circuit 4, generally external to the head, escapes from the cavity through at least one gauge nozzle 10 thus forming at least one ink jet 7.

A periodical stimulation device 63 is associated with the cavity in contact with the ink upstream of the nozzle 10; it transmits, to the ink, a (pressure) periodical modulation which causes a modulation of velocity and jet radius from the nozzle. When the dimensioning of the elements is suitable, this modulation is amplified in the jet under the effect of surface tension forces responsible for the capillary instability of the jet, up to the jet rupture. This rupture is periodical and is produced at an accurate distance from the nozzle at a so-called «break» point 13 from the jet, which distance depends on the stimulation energy. In the case where a stimulation device, called an actuator, the motive member of which is a piezoelectric ceramics, is in contact with the ink of the cavity upstream of the nozzle, the stimulation energy is directly related to the amplitude of the electrical signal for driving the ceramics. Prior art teaches other jet stimulation means (thermal, electro-hydrodynamic, acoustic, . . . ) but the stimulation using piezoelectric ceramics remains the most widespread thanks to its efficiency and relative workability.

At its breaking point 13, the jet, which was continuous from the nozzle, is transformed into a train 11 of identical and evenly spaced apart ink drops. The drops are formed at a time frequency identical to the frequency of the stimulation signal and for a giving stimulation energy, any other parameter being otherwise stabilised (in particular ink viscosity), there is an accurate (constant) phase relationship between the periodical stimulation signal and the breaking instant, itself periodical and with a same frequency as the stimulation signal. In other words, to an accurate instant of the period of the stimulation signal corresponds an accurate instant in the separation dynamic of the jet drop.

Without further action (this is the case where drops are not used for printing), the drop train travels along a trajectory 7 collinear to the drop ejection axis (nominal trajectory of the jet) which joins, by a geometric construction of the printing head, the recovery gutter 62. This gutter 62 for recovering non-printed drops uptakes the ink not used which comes back to the ink circuit 4 to be recycled.

For printing, the drops are deflected and deviated from the nominal trajectory 7 of the jet. Consequently, they escape from the gutter and follow oblique trajectories 9 which meet the support to be printed 8 at different desired impact points. All these trajectories are in a same plane. The placement of the drops on the matrix of impacts of drops to be printed on the support, to form characters, for example, is achieved by combining an individual deflection of drops in the head deflection plane with the relative movement between the head and the support to be printed (generally perpendicular to the deflection plane). In the deviated continuous jet printing technology, the deflection is achieved by electrically charging drops and by passing them into an electric field. In practice, the means for deflecting drops comprise an individual charging electrode 64 for each jet, located in the vicinity of the break point 13 of the jet. It is intended to selectively charge each drop formed at a predetermined electrical charge value which is generally different from one drop to the other. To do this, the ink being held at a fixed potential in the drop generator 60, a voltage slot with a determined value, driven by the control signal, is applied to the charging electrode 64, this value being different at each gutter period.

In the control signal of the charging electrode, the voltage application instant is shortly before the jet fractionation to take advantage of the jet electrical continuity and attract a given charge amount, which is a function of the voltage value, at the jet tip. This variable charge voltage affording the deflection is typically between 0 and 300 Volts. The voltage is then held during the fractionation to stabilize the charge until the detached drop is electrically insulated. The voltage remains applied still a time after to take break instant issues into account.

Thus, it is attempted to synchronise the voltage application instant with the jet fractionation process. In case of desynchronisation, the drop in question is not properly charged, its charge is lower, or even zero.

The drop deflecting means also comprise a set of 2 deflection plates 65 placed on either side of the drop trajectory upstream of the charging electrode. Both these plates are put to a high fixed relative potential producing an electrical field Ed substantially perpendicular to the drop trajectory, capable of deflecting the electrically charged drops which are engaged between the plates. The deflection amplitude is a function of the charge, the masse and the velocity of these drops.

In order to control the deflection of the drops for printing, it is attempted to produce a quality breaking in the range of variation of the environmental conditions provided by specifications.

Thereby, it is attempted to make sure that:

on the one hand, the breaking is found in the field of the charging electrode, thus at a determined distance from the nozzle (break position);

and, on the other hand, that the jet breaking is stably and reliably made (break quality: which will be set out below). This is made by an optimum setting of the stimulation which is practically made by acting on the stimulation energy. In most cases in prior art, the stimulation energy is controlled by the level Vs in the periodical voltage signal applied to the stimulator (piezoelectric component).

A breaking is considered as stable and reliable (with a good quality), when it enables an optimum charging of the drops to be guaranteed in an operating range of the printer characterised in particular, by a temperature range (conditioning the ink viscosity) for a given ink.

Concretely, just before breaking, the drop is connected by a tail to the following drop being formed (see FIG. 3A). The shape of this tail determines the breaking quality. The most characteristic shapes of a problematic breaking are the following ones (but many intermediate situations which are more or less stable can exist):

very thin tail (see FIG. 3B) which is at risk of being unstably broken (the surface tension cohesion forces become low with respect to the electrostatic forces). When there is a very high electric field between 2 successive drops charged at very different values (case of a strong charge followed by a low charge), a point effect phenomenon at the tail creates electrostatic forces such that charged particles are torn out of the very thin tail of the strongly charged drop and join the low charge drop by transferring charges. Consequently, the drops have no longer their nominal charge, the deflection is therefore disturbed and the printing quality is degraded;

a tail having a lobe between 2 throttles (see FIG. 3C), which can be broken into 2 places and create an insulated satellite separated from the drop, which takes in part of the charges intended to the drop concerned:

if its velocity is quicker than the jet (quick satellite), the satellite and its charges will join the drop concerned and remake a nominal situation without notorious repercussion on the printing quality;

if the satellite velocity is identical to that of the jet (infinite satellite) or does not join the drop concerned before its deflection, this will be poorly charged and the satellites will be violently deflected with the risk of fouling the printing head;

if it joins the following drop (slow satellite), it will transfer charges of the drop concerned to the following ones and disturb the deflection.

The breaking shape, besides the rheological characteristics of the ink, is related to the stimulation level (excitation intensity). The breaking shape determines the breaking quality, that is its ability to ensure the proper charging of the drops.

Generally, it is modified, when the excitation increases, to switch from a satellite breaking, and then to a satellite-free breaking. The satellite is defined as a secondary drop from the breaking of the main drop.

By further increasing the stimulation level, the breaking goes back to a satellite regime. Meanwhile, the break position with respect to the nozzle changes by following the curve of FIG. 4.

The latter represents the profile of the characteristic f giving the breaking distance ($L_b$) between the nozzle 10 and the break point 13, as a function of the stimulation voltage VS ($L_b$=f(VS)). This curve will be called in the following: a stimulation curve. This is set by scanning values of the stimulation excitation voltage VS and by determining Lb for each value of VS.

When the stimulation excitation increases (from a low value), the nozzle/break distance ($L_b$), which starts from a high value (natural jet breaking), decreases and passes through a minimum called a «turn», and then is extended again. The shape and the real position of this curve depend on many parameters, in particular the ink nature and temperature. The printing head is designed such that the functional part of this curve is found, at least partly, in the field of the charging electrode in spite of the variability in the parameters mentioned. On the other hand, there is a functional zone related to the breaking quality in which the printing is satisfactory (the charging of drops is proper). The intersection of the properly positioned zone in the electrodes and the functional zone of breaking quality corresponds to the stimulation operational range. This stimulation range is characterised by an input point (Pe) on the left, and an output point (Ps) on the right as indicated in FIG. 4. The stimulation system will be satisfactory if the stimulation operational range is sufficiently well defined regardless of the conditions of use of the printer.

At least two distinct operating modes for the piezoelectric stimulation are used in ink jet printers of the state of the art: these are resonant and non-resonant stimulation modes.

The non-resonant stimulation is relatively difficult to implement and demands a significant energy because the actuator has to provide the entire energy necessary for creating the displacement of the actuator portion in contact with ink in order to generate the pressure modulation upstream of the nozzle. On the other hand, this mode is relatively tolerant to variabilities of the excitation conditions.

In comparison, the resonant stimulation has much more advantageous yield within the scope of a periodical stimulation which results in the periodic breaking of a drop jet at a fixed frequency, as is often the case in continuous jet type printing methods. Indeed, in this case, it is very efficient to design an actuator as an oscillating or vibratory system, substantially tuned to the drop emission frequency; a low periodical excitation can then maintain an amplified standing wave which will generate the displacement amplitude necessary for the pressure modulation upstream of the nozzle.

Under sensible conditions of implementation, a simple piezoelectric ceramics (used in mode D33, the electric field created between 2 electrodes deposited onto the ceramics thus producing a longitudinal stretching or contraction thereof as a function of the polarisation direction and the polarity of the electric signal) cannot be used on its own as an actuator because it would not have a sufficient deformation amplitude (in the order of one nanometer only) to create the expected ink ejection velocity modulation; thus, it is fixed to a piece, called a resonator, used for amplifying the movement. The ceramics/resonator assembly is called an actuator.

It could have been noticed that, for some inks and dimensionings of the drop generator, the stimulation efficiency is not stable as a function of temperature.

This can be up to the impossibility to operate the printer at some distinct temperatures of at least 15° C. or 20° C., and/or under some temperature ranges, in particular at 5° C. or at 15° C., and at 35° C. and/or at 45° C. (and/or 50° C.) and/or between these different values taken two by two, in particular between 15° C. and 35° C. or between 5° C. and 45° C. (or even 50° C.).

Indeed, under some conditions, the stimulation becomes completely inefficient and the operational stimulation range is moved and/or is weakened up, in some cases, to disappear, which makes the machine setting impossible.

It can be tried, in some cases, to adapt the stimulation setting as a function of the predictable temperature change range during the production session during which the printer is used. But this is not always possible.

Finally, if this instability is desired to be compensated for, further means (temperature control of the head, for example) have to be implemented, which imposes an additional cost.

Consequently, there arises the problem of finding a device and a method, which allow for a satisfactory operation at at least 2 different temperatures of at least 15° C. or 20° C., in particular, on the one hand at 5° C. (and/or at 15°), and on the other hand at 35° C., and/or at 45° C. and/or at 50° C., preferably between any two of these values, in particular between 15° C. and 35° C. or between 5° C. and 45° C. (or even 50° C.).

Another problem, in a system implementing a resonating mechanical actuator, is that the actuator resonance is coupled with the fluid resonance, in particular by the fact that the ratio of acoustic velocities, on the one hand in the material used for the resonator (for example stainless steel) and on the other hand in the fluid (about 5 000 m/s in the resonator, about 1 250 m/s in the fluid) in the order of 4, that is a quarter wavelength. The consequences of this ratio are the abovementioned coupling.

Disclosure of the Invention

The invention aims at solving these problems.

According to the invention, a device for forming and ejecting drops of an ink jet of a CIJ printing machine includes:

a) a cavity for containing an ink and including an end provided with a nozzle for ejecting ink drops, b) actuator means, in contact with the cavity.

In such a device, the acoustic impedance of the cavity, in the proximity of the nozzle, has a value $Z_T(f_t)$, at the operating frequency of the cavity and of the actuator. Preferably, this acoustic impedance does not vary, or varies a little, in a frequency range of ±5 kHz about the operating frequency $f_t$, such that the variation in the velocity modulation in the nozzle remains between, on the one hand, 0.25 (or 0.5), and, on the other hand, 2 (or 4), times the velocity modulation at the reference temperature (for 25° C. for example), and at at least 2 positive temperatures distant by at least 10° C. or 20° C., in particular at 15° C. and at 35° C., preferably also at 5° C., and/or at 10° C. and/or at 20° C., further preferably at 45° C. or even at 50° C., further preferably at any temperature in a temperature range which contains at least the interval [15° C.-35° C.], or even at least the interval [5° C.-50° C.].

Such a device according to the invention enables resonance and anti-resonance frequencies, due to the ink cavity, to be displaced such that their drift as a function of temperature does not cause them to intersect the jet stimulation frequency, at at least 15° C. and 30° C. (or at 35° C.), also preferably at 5° C., and/or at 10° C. and/or at 20° C., further preferably at 45° C. or even 50° C., further preferably at any temperature in a range between 15° and 35° and more generally between 5° and 50° C. These temperatures and/or temperature ranges are indeed those of operating specifications of many printers.

Preferably, said cavity is such that the ratio of the length of the mechanical actuator to the length of the or a portion of the cavity intended to accommodate a fluid column, is strictly higher than 4; this ratio can for example be between 4 and 6 or 4 and 10 or 100.

According to a first embodiment, the internal shape of the cavity can include:

- a first cylindrical zone, having a first diameter, and a first length, measured along a longitudinal axis of said cavity,
- a second cylindrical zone having a second diameter, different from the first diameter, and a second length, measured along a longitudinal axis of said cavity.

Thus, a cavity having at least 2 cylindrical sections with different diameters is created, so as to displace their own frequency modes of the ink cavity for sound velocities in usual inks. Cylindrical sections of different diameters enable a variation in the fluid length to be made.

The actuator means, for example a piezoelectric ceramics, can be directly in contact with the internal volume of the cavity.

The actuator means can include a resonator element. The actuator is thereby resonating.

According to one embodiment, this resonator element includes a resonator body disposed in the cavities.

According to another embodiment, the walls of the cavity form at least one part of the resonator.

The resonator can be of a metal or mineral nature, for example of stainless steel, aluminium, beryllium, brass, copper, diamond, glass, gold, iron, lead, TMMA, silver, or titanium.

The resonator body can include a first part having a first diameter and a second part having a second diameter, different from the first one.

The invention also relates to a device for forming and ejecting drops of an ink jet of a CIJ printing machine, this device including:

a) a cavity for containing an ink and including an end provided with a nozzle for ejecting ink drops, b) actuator means, in contact with the cavity, of a material chosen from aluminium, beryllium, brass, copper, diamond, glass, gold, iron, lead, TMMA, silver, or titanium.

The length of the ink cavity is generally comparable to the length of the resonator under a flange, the latter being chosen to allow for the mechanical resonance of the actuator.

The physical properties of the resonator are adjusted to enable the device to be resonated at a given frequency.

The choice of a material other than stainless steel, and possibly of the length of the bar and thus of the ink cavity, enables the resonance and anti-resonance frequencies, undesirable in ink, to be displaced off the useful range (actuator resonance).

The choice of such a material for the resonator means thus enables parasitic resonances due to a liquid contained in the cavity to be cancelled.

The resonator means can include a piezoelectric element.

The resonator can be inserted in a resonator body having a constant or variable cross-section in the longitudinal direction.

This resonator body can include a first part having a first diameter and a second part having a second diameter, different from the first one.

Both embodiments can be combined to optimise the final implementation.

In either or both embodiments, a device for forming and ejecting drops according to the invention can contain an ink, for example an ink in which the sound velocity is between 800 and 2 000 m/s.

The invention also relates to a continuous ink jet (CIJ) type printing machine, this machine including:

- a printing head, provided with a device for forming and ejecting drops of an ink jet according to one of the embodiments described above,
- an ink circuit,
- means for controlling the circulation of ink and the printing head.

The invention also relates to a method for forming ink drops, in which a device as described above or a machine as described above is implemented.

The invention enables the resonant stimulation principle to be preserved with its advantages (efficiency, cost).

It can be applied to different implementation types of drop generator.

The combination of both embodiments introduced (cavity having several acoustic impedances, and specific material chosen for the resonator) enables some drawbacks unique to each mode to be limited; it makes it possible in particular to achieve a compromise between:

- a satisfactory overall space, since it is related to the bar length (depending among other things on the sound velocity);
- an easy washing of the cavity, in connection with the complexity and ink headspace in the cavity.

BRIEF DESCRIPTION OF THE DRAWINGS

FIG. 3A-3C represent different break configurations, FIG. 3A representing a good quality break, FIG. 3B a thin tail break (at risk of tearing out of matter) and FIG. 3C a lobe break (at risk of satellites), FIG. 4 is a curve indicating the time change of the break distance as a function of the stimulation excitation.

DETAILED DISCLOSURE OF PARTICULAR EMBODIMENTS

In FIGS. 5A, 5B, 5C, 5D and 5E, five types for implementing a stimulation actuator in a stimulation body 20, 30, 40, to which the invention can be applied, are represented. Some of them (FIGS. 5A, 5D) include a resonator which is intended to be dipped in the ink when this is present in the cavity.

Figure 5A:
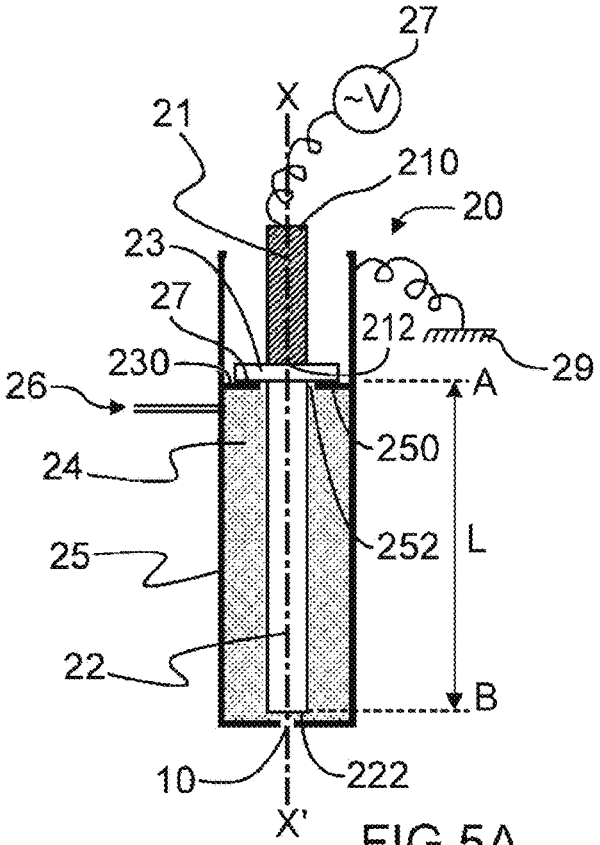
FIG. 5A-5E represent structures of stimulation bodies 20, 30, 40, 50 and 60 to which the invention can be applied.

The stimulation body 20 of FIG. 5A includes an envelope 25 the internal volume of which has, preferably, a cylindrical shape and extends along an axis XX'.

The body 20 further includes an actuator comprising a ceramics 21, of a piezoelectric material, with a cylindrical shape along the axis XX'. The actuator is mounted in the envelope 25 of the modulation body 20.

This ceramics is metallized on its 2 faces 210, 212, perpendicular to the axis XX'. It is coaxially secured to a cylindrical metal bar 22. For example, the securement is made by gluing with a glue, which can advantageously be a conductive glue.

According to the embodiment illustrated, this bar includes a circular flange 23 on which the face 212 of the ceramics is attached.

The envelope 25 can be provided with a seat or an inner bearing surface 250, which is perpendicular to the axis XX' of the cylinder and which is provided with a hole 252 through which the cylindrical metal bar 22 can be introduced. A bearing surface 230 of the circular flange 23 can thus bear against the inner bearing surface 250.

Mechanical means, not represented, enable the flange 23 (thus the actuator) to be centered and clamped to the surface 250.

The internal volume of the envelope 25, located under the surface 250 and the flange, defines an insulated cavity 24.

In use, the cavity is supplied with pressurised ink by a conduit 26.

A nozzle 10 from which the jet exits is placed at the bottom of the cavity 24, and the assembly is calculated such that the active face 222 at the end of the bar 22 is located above and close to the nozzle 10, preferably at a distance of a few tenth mm, for example between $2/10^{th}$ mm and $5/10^{th}$ mm.

Each of the internal elements (actuator, envelope 25, nozzle 10) of the modulation body is of a circular cross-section and these different elements are coaxially placed with respect to each other, on the axis XX'.

For practical reasons, the bar 22 is, preferably:

of a significant hardness (shapeable through machining);

of a conductive or metallized material, to shift the electrical voltage zero applied to the ink onto one of the electrodes of the ceramics 21;

insensitive to corrosion if it is in contact with the ink.

One material that can be used is a stainless steel, which has all the characteristics mentioned above.

By construction, the bearing surface 27 of the flange 23 corresponds to a vibration node of the actuator, which avoids efficiency losses by energy transmission into the structure of the modulation body.

Besides, it is preferable that the end 220 of the bar 22, which is located above the nozzle 10, benefits from a maximum movement amplitude which corresponds to a vibration antinode.

In practice, the actuator can be tuned such that the resonance is located in the vicinity of the operating frequency (so-called "drop" frequency, or even frequency at which the drops are wanted to be generated), but not exactly identical not to make the system too sensitive to variations in conditions of implementation of the actuator (mechanical tolerances of an actuator to the other for example). The tuning is generally made in air, at a frequency offset from the operating frequency, for taking the frequency sliding, related to the impedance difference existing when the bar is located in different materials (ink for example), into account.

In this example, the part of the bar 22 under the flange 23 is placed in the cavity 24 (body of the drop generator) the length of which is substantially identical to that of the bar 22.

In use, the electrode 210 of the ceramics 21 is connected to powering means 27. The body 25 can be connected to a ground 29 which will be shifted to the electrode 212 through the flange 230.

Figure 5B:
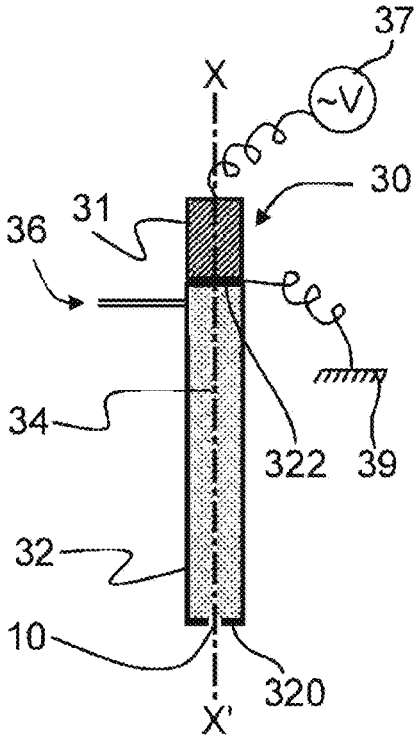

FIG. 5B describes a second embodiment of the resonating modulation body 30.

Its operation is close to that described above in connection with FIG. 5A.

There is again a cavity 34, with a cylindrical internal shape, delimited by two end surfaces 320, 322, perpendicular to the axis XX'. Pressurised ink is brought into this cavity by a conduit 36. A $1^{st}$ end of this tubular cavity is closed by the partition wall 322 perpendicular to the axis XX'. A nozzle 10 is formed in the $2^{nd}$ end partition wall 320, to let a jet to out along the axis XX'.

It is the envelope 32, which delimits the cavity 34, which provides the function ensured by the bar 22 of the first embodiment. It is excited by a piezoelectric ceramics 31 secured by a mechanical means or by gluing onto the partition wall 322. The ceramics-envelope assembly forms a resonator, the partition wall 322 being at a vibration node, the maximum movement amplitude being located at the plate 320, provided with the nozzle 10. The length L of the envelope is thus chosen to create a standing wave in the vicinity of the operating frequency, in the length of the envelope 32. In this case, the impedance influence brought about by the ink present in the cavity is to be taken into account to tune the assembly to the proper frequency.

In use, one electrode of the actuator (for actuating the ceramics 31) is connected to powering means 37. The envelope 32 can be connected to a ground 39.

Figure 5C:
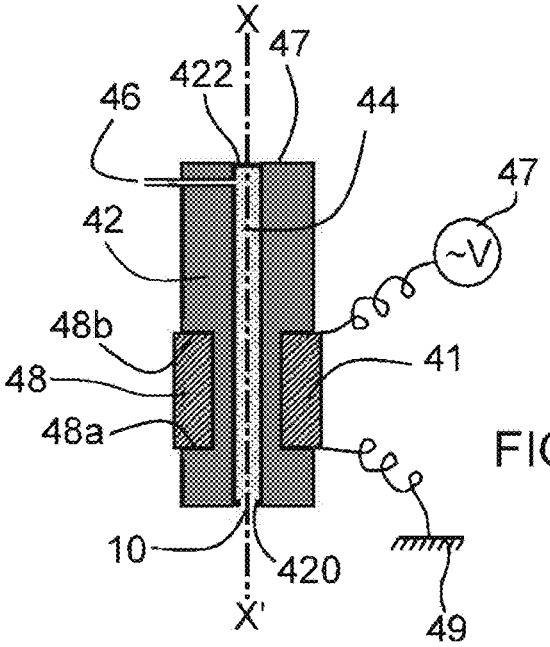

FIG. 5C describes a third embodiment, in which a piezoelectric ceramics 41 is annular and is placed in a throat 48 of a circular envelope 42 having a tubular cavity 44. The cavity is closed at the top by a partition wall 422 and, at the bottom, is located a plate 420 provided with a drop ejecting nozzle 10. The ink supply is made through a conduit 46.

Upon mounting, the ceramics 41 is clamped between the flanks 48*a* and 48*b* of the throat. Under the effect of a periodical electric field created between electrodes, disposed as a crown on the faces of the ceramics element 41, which are perpendicular to its axis, this is longitudinally deformed and transmits this vibration to the envelope 42 to which it is secured. This excitation is transmitted to the nozzle 10 and then to the jet. As in the embodiment of FIG. 5B, it is the envelope that plays the role of the resonator.

In use, the actuator 41 is connected to powering means 47, this electrode is electrically insulated from the envelope 42. The envelope 42 can be connected to a ground 49.

Figure 5D:
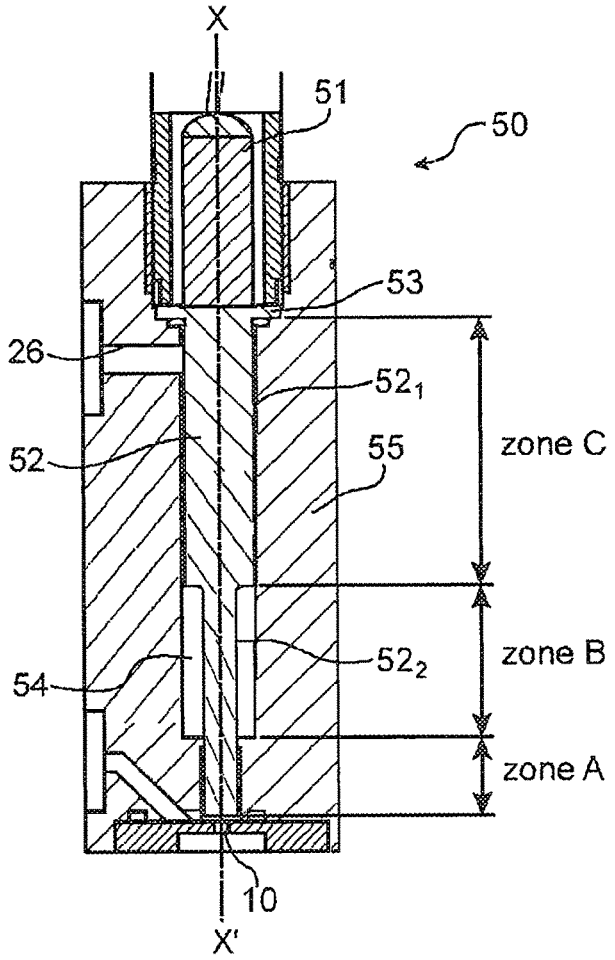

FIG. 5D describes a fourth embodiment, which indeed is an alternative of the first embodiment described above. Reference numerals identical to those of FIG. 5A designate identical or corresponding elements. References 51 and 52 respectively designate the piezoelectric ceramics and the resonator.

Unlike the structure of FIG. 5A, the resonator 52 includes, from the flange 53, 3 sections $\mathbf{52}_1$, $\mathbf{52}_2$ and $\mathbf{52}_3$ with different diameters: a first one $\mathbf{52}_1$ with a diameter slightly lower than the diameter of the port in which the actuator is inserted, a second one $\mathbf{52}_2$ with a lower diameter and which will enable a volume 54 in which the ink will be stored to be delimited, a third one $\mathbf{52}_3$ with a still lower diameter and terminating the conduit which will bring the ink to the nozzle. Indeed, the difference between the first diameter and the diameter of the wall of the envelope 25 in which the actuator is inserted enables ink to be circulated, which is injected through the side conduit 26. This actuator type is generally used for generating drops with a so-called "intermediate" size and its shape is optimised for the operating conditions (in particular the operating frequency) in a given overall space imposed by the mechanics implemented on the printed head. In this Fig., zones A, B, C are marked, which will be used in the following of the description.

The part of the bar under the flange 53, 23 is placed in the cavity (body of the drop generator) the length of which is once again substantially identical to that of the resonator 52 of the cavity 54.

Explications already given above in connection with FIG. 5A and in particular those relating to the connection of the powering means and the operating frequency of the actuator are applicable herein.

The printing head can have a mechanical configuration which is common for several types of drop generators which produce drops with different sizes (to simplify: high, intermediate and possibly small), accordingly which operate at different frequencies. The overall space and the inputs/outputs can thus be identical for all types of generator; the cavity length can also be very close for these different types. For the different resonator types to be able to operate at different frequencies while preserving a length between flange and nozzle which is substantially identical, the bar shape can be acted on. Consequently, the bar for a head G (lowest frequency) is a simple cylinder the length of which is the highest (FIG. 5A for example), and that of a head M (higher frequency) has a more complex shape (2 diameters, FIG. 5D for example) which enables a length substantially identical to the head G to be kept by operating at a higher frequency.

But the problem to be solved, set out in the present application, and in particular herein below, which is that parasitic resonances generated in the liquid column interfere with the stimulation as a function of temperature, remains the same. The parasitic character of these resonances has not been emphasised in prior art, in particular in documents JP 2006-076039 or JP-2005-081643, or even U.S. Pat. No. 5,063,393 or JP-S58-3874.

Figure 5E:
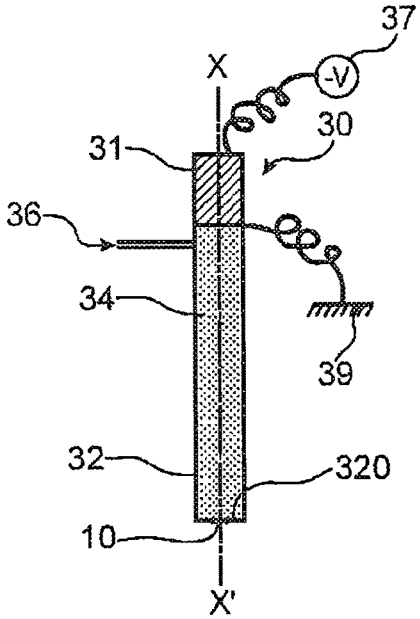

FIG. 5E represents another type of device to which the invention can be applied. Reference numerals identical to those of FIG. 5B designate the same elements.

Once again, there is a cavity 34, with a cylindrical internal shape, delimited, on the side of the nozzle 10, by an end surface 320 perpendicular to the axis XX'. Pressurised ink is brought into this cavity through a conduit 36.

The other end of this tubular cavity is in direct contact with an actuator, here a piezoelectric ceramics 31 (itself held by a peripheral flange to the wall of the cavity).

In this figure, the cavity is of an elongate shape, according to the axis XX'. But it can also be curved.

In use, an electrode of the actuator 31 is connected to powering means 37. The envelope 32 can be connected to a ground 39.

In this device, the envelope 32, which delimits the cavity 34, does not provide a function as ensured by the bar 22 of the first embodiment. The ceramics-envelope assembly does not form a resonator. The ink is directly vibrated by the actuator 31 and resonances are formed in the cavity at the operating frequency.

This type of device has the same problems as those introduced above, in particular for the other devices as those of FIG. 5A-5D.

Generally, the optimum operating frequency of a jet is determined for the different parameters defining the same. Among these parameters, there are:

- the diameter of the nozzle (that can be between 40 μm and 80 μm),
- the jet velocity (that can be between 18 and 24 m/s),
- physico-chemical parameters of the ink: surface tension (for example between 20 and 60 mN/m), dynamic viscosity (for example between 2 and 10 cps) and density (for example between 800 and 1 400 Kg/m$^3$).

The operating frequency can be adjusted using means 27, 37, 47 for applying a voltage to the piezoelectric element.

The stimulation efficiency is represented by the break length $L_b$ as a function of the jet excitation frequency.

$L_b$ can be measured by observing the jet with a camera and a stroboscopic lighting synchronised to the drop period (this enables the image of the drops being formed to be fixed). Then, the distance between the nozzle and the break is measured by micrometric displacement of the camera.

Another technique is described in document WO 2012/2107560 (see in particular the description in connection with FIG. 5A-5C of this document), or even in WO 2011/012641, when the drops are charged (at a constant drop forming frequency).

Figure 6:
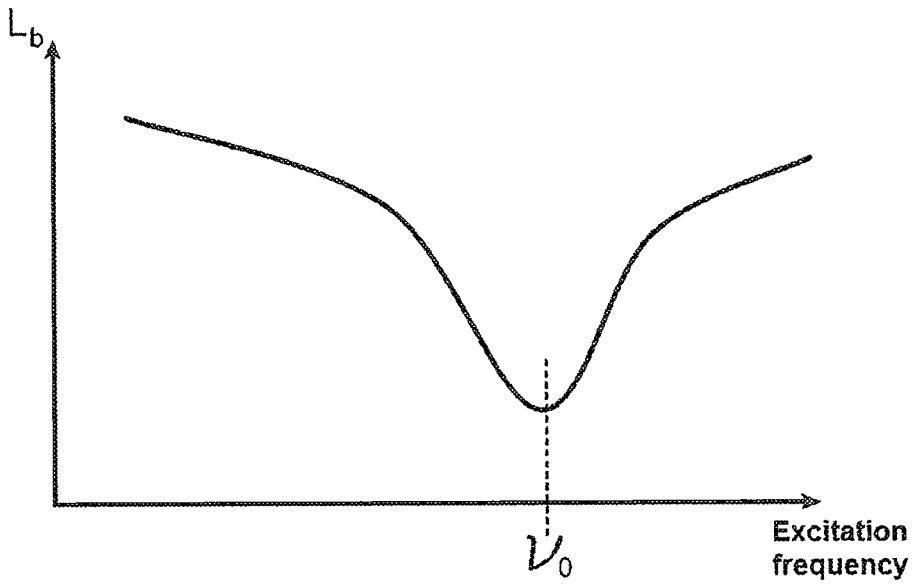
FIG. 6 is a curve of stimulation efficiency, giving the break length as a function of the jet excitation frequency.

Generally, it is considered that the lower the break length, the higher the stimulation efficiency. The curve of FIG. 6 represents the time change of $L_b$ as a function of the jet excitation frequency. The frequency for which the amplification of the velocity or radius modulation is the highest is referred to as jet resonance frequency. Generally, the actuator frequency is adjusted in proximity of this frequency. Indeed, since the jet is defined by its diameter, its velocity output from the nozzle and the fluid that makes it up (responsible for the capillary instability of the jet through the surface tension of this fluid), the jet behaves as a system resonating at a given favoured frequency. When periodically excited by a velocity modulation, the capillary instability reflects it into a periodic variation in the jet diameter which will be amplified up to the jet rupture. The length $L_b$ where this rupture is located as a function of the excitation frequency is representative of the jet resonance for a given stimulation voltage.

According to what is indicated above, the optimum excitation frequency $v_0$ is that which corresponds to the absolute minimum of the length $L_b$.

Figure 12A:
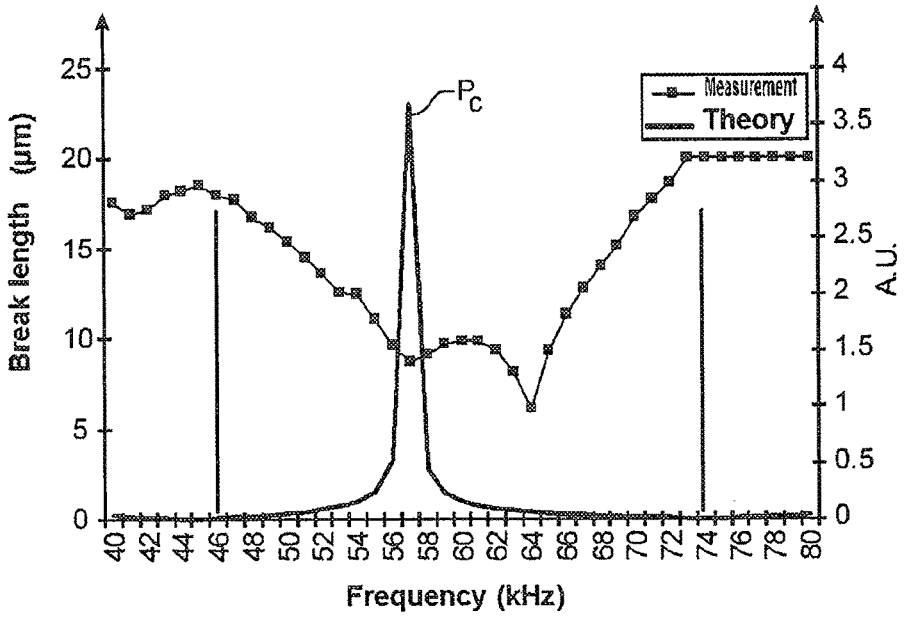
FIG. 12A-C represent test results obtained with another type of stimulation body.
Figure 12B:
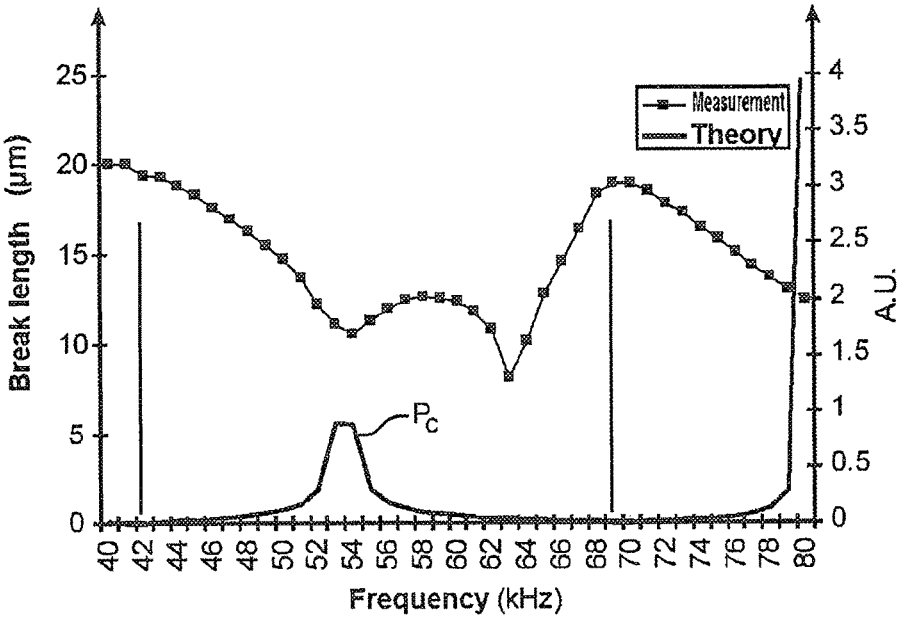
Figure 12C:
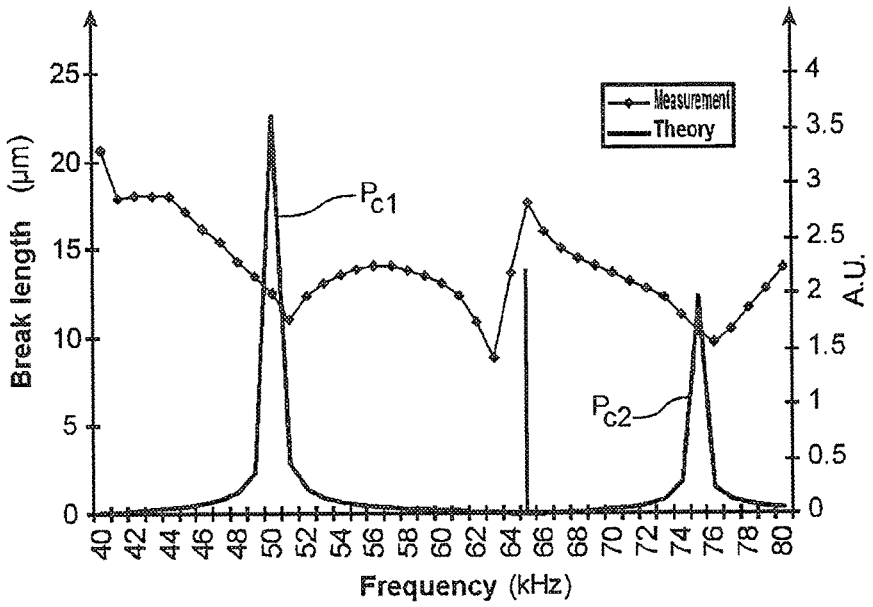

However, it could have been noticed that the actual curves of the time change of Lb as a function of the jet excitation frequency, examples of which are represented in FIG. 12A-12C (which will be further discussed herein below), do not have the ideal shape of FIG. 6. These actual curves show that the actual frequency response is disturbed by additional frequency events.

More precisely, it could have been emphasised that, upon use of any of the stimulation bodies, 3 resonance systems are involved: the jet resonance, the actuator or resonator resonance and the resonance of the fluid cavity of the drop generator. In other words, some frequency behaviours have been observed, which correspond neither to the actuator resonance nor to the jet resonance.

The jet instability is excited by the actuator, which thus ensures its stimulation function. The actuator is preferably designed such that both resonance frequencies, that of the jet and that of the actuator, are close to each other.

In comparison with these 2 resonances, the resonance of the fluid cavity is a parasitic resonance. It causes the formation, in the ink, of a standing wave which is very sensitive to temperature. This standing wave comes to be superimposed to the actuator excitation.

For the so-called "resonating" actuator family, the resonance frequency of the actuator depends on the velocity of the acoustic waves in the material of the resonator bar and the dimensioning thereof. In the case of the structure of FIG. 5A, the length of the resonator is such that, at the resonance frequency, there is a vibration node at the holding flange, and an antinode at the end.

The resonator (or the envelope in the embodiments of FIGS. 5B and 5C) is generally of stainless steel, in which material the sound velocity is in the order of $C_{stainless\ steel}$=5 790 m/s.

The properties of some inks are such that the velocity of waves in the ink is around 4 times lesser than in stainless steel ($C_{ink}$≈1 200 m/s). As a result, the ink cavity also makes up a resonator in which a standing wave can be developed, the resonance or anti-resonance frequency of which will be close to the resonance frequency of the actuator.

Figure 16:
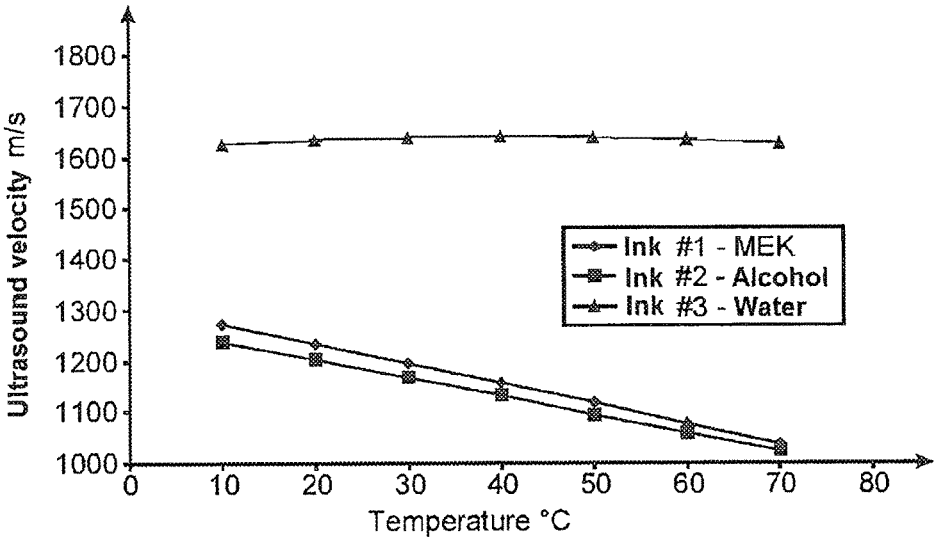

The velocity of the waves in stainless steel (or, more generally, in the material making up the bar) has a very low sensitivity to temperature whereas that of the waves in the ink is of a very high sensitivity to temperature (variation between −3 and −4 m/s per ° C.). Data regarding the time change of this velocity as a function of temperature are gathered in FIG. 16 for inks based on MEK (MethylEthyl-Ketone) solvent, alcohol or water. In this Fig., data on the sound velocity in an ink #1 (the solvent of which is MEK) and #2 (the solvent of which is alcohol) show a strong enough variability. The variability is lower for an ink #3, with a "water" base.

The resonance modes in the resonator and in the cavity are very close to each other and change in differently as a function of temperature. The resonance and anti-resonance modes of the fluid cavity can thus be displaced as a function of temperature, by intersecting the mode of the resonator which in turn only varies very little as a function of temperature. As a result, there are disturbances in the stimulation in some temperature ranges.

A first study conducted on this problem relates to the case of a drop generator provided with a stimulation body of the type of FIG. 5D.

Figure 7A:
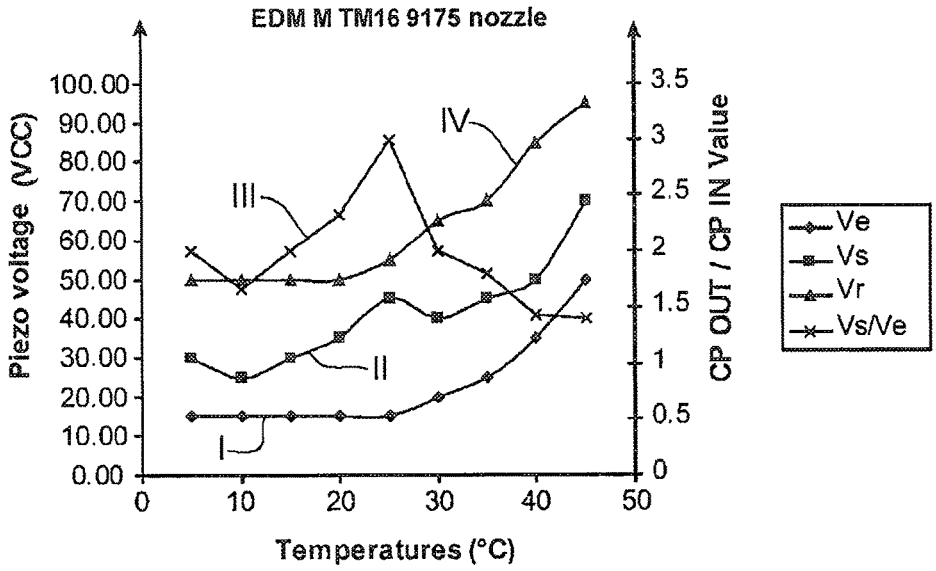
FIG. 7A-7B represent results obtained with a stimulation body of the type of FIG. 5D.

In FIG. 7A, the curve I represents the time change of Ve, that is of the input voltage of the stimulation range, as a function of temperature. As can be seen in this curve, at the range start, the stimulation voltage remains stable, in other words it reflects the stimulation efficiency. On the other hand, this voltage tends to significantly increase for a low to high temperature scanning from 25° C.

On the same Fig., the curve II represents the time change of Vs, that is the output voltage of the stimulation range, as a function of temperature. A peak is noticed on this curve II, at about 25° C.

Curve III represents the time change of Vs/Ve, that is the input voltage/output voltage ratio of the stimulation range, as a function of temperature. This ratio is representative of a sturdiness of the stimulation: the higher, the easier the printer to be set since a single stimulation voltage enables quality drops to be formed throughout the temperature range. Here, it is noticed that from about 25° C., the drift is very high.

Curve IV represents the time change of the voltage at the turn Vr. This is initially stable, and then, as the input voltage, increases as a function of temperature, from about 25° C.

Figure 7B:
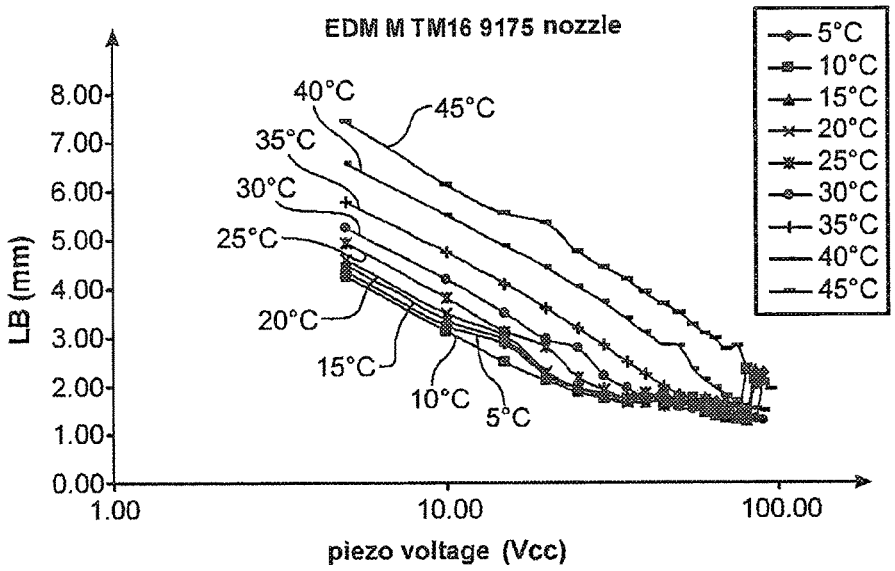

Curves that represent the time change in the break length Lb as a function of temperature (from 5° C. to 45° C., by 5° C. pitch) and the stimulation voltage could be set. These curves are represented in FIG. 7B.

From these curves, it has been attempted to determine how the stimulation efficiency changes as a function of temperature. For this, at a given voltage, it appears that the break length Lb can vary by a factor 2 as a function of temperature. Based on the capillarity instability theory, the following expression is obtained:

$$\frac{Lb}{2a} = \frac{\sqrt{We}}{2\gamma}\mathrm{Ln}\left(\frac{V_j}{\Delta V_j}\right)$$

with:

Lb: break length a: jet radius from the nozzle

Vj: mean jet velocity

ΔVj: jet velocity modulation (result of the stimulation process)

γ: dimensionless growth rate of the modulations which is substantially constant on the operating range (in particular the temperature range)

We: Weber number.

The velocity modulation varies exponentially with the break length and thus the stimulation varies in proportions much higher than a factor 2.

Since the purpose is to compare modulation levels at different temperatures, it is shown that the stimulation efficiency dramatically drops between 20° C. and 40° C. The influence of temperature can vary by a few % the input parameters (typically by the surface tension, . . . ), which is irrelevant to the orders of magnitude on the stimulation efficiency.

To explain this abrupt efficiency variation, one can contemplate:

a non-linearity, not identified to date (unlikely);

or a resonance phenomenon.

The stimulation body can thus be regarded, by searching for resonances in the solid and liquid.

As a first approximation, it can be reasonably considered that the materials of the resonator, for example ceramics and stainless steel for the bar are stable on a range of a few tens of degrees. The charge brought back by the ink, onto the actuator, does not enable the drastic change on the stimulation efficiency to be explained.

In the liquid (anywhere where the ink is present), an acoustic resonance phenomenon can exist as soon as its greatest dimension is in the order of the wavelength.

At 83 KHz and for a velocity in the order of 1 200 m/s (in a MEK-based ink), the wavelength is typically 15 mm, which is shorter but however comparable in order of magnitude to the height of the stimulation body (here about 21 mm, in an exemplary geometry of FIG. 5D).

A relationship which expresses the dependence between the modulation generated by the piezoelectric actuator and ΔVj, the jet velocity modulation, can be set by including the propagation phenomenon in the ink. The complete transfer function can be determined and the existence of resonance frequency related to the ink and in proximity of the operating frequency can be searched. These frequencies (resonance or transmission zero (anti-resonance)) will then be subjected to a sensitivity study as a function of temperature. It is interesting to check whether these frequencies drift and/or intersect the operating frequency (imposed by the actuator).

Figure 8:
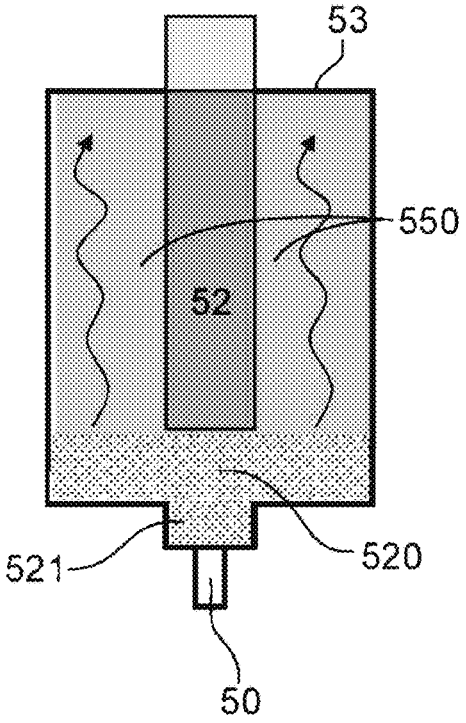
FIG. 8 illustrates a schematic model of a stimulation body.
Figure 9:
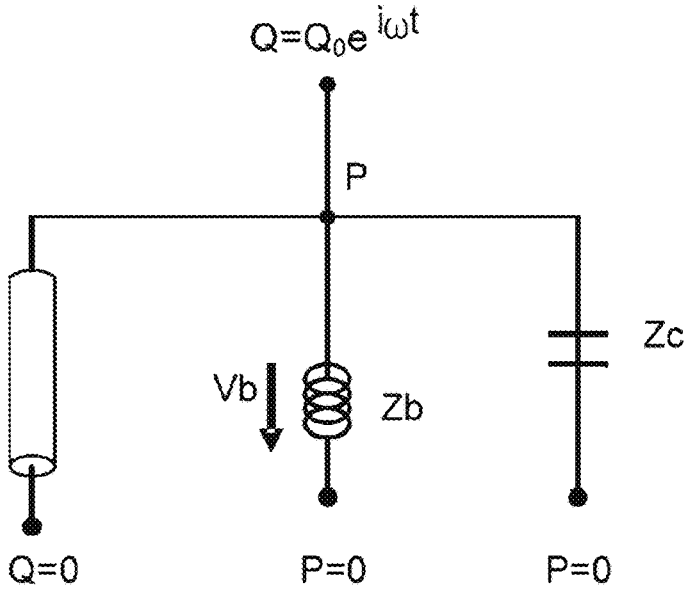
FIG. 9 is an electrical analogy of the equivalent scheme of a stimulation device.

The drop generators can be schematically construed in order to list the main functional elements thereof. FIG. 8 (and its equivalent, in terms of an electrical circuit, represented in FIG. 9) shows the simplified version of the drop generator by making apparent 4 elements:

the source term: the piezoelectric actuator which modulates the ink flow rate (which is the inflow rate);

the loss terms: these are outflow rates which balance the inflow rate. Here, there are 3 terms: the ink wedge 520 under the actuator 52, the nozzle 50 and the top 550 of the stimulation body in which an acoustic wave can be propagated.

The resonator body, for example of stainless steel, is considered as being non deformable: the walls have a null velocity condition regardless of whether it is in flow or propagation.

The physical behaviour of the functional elements of the drop generator and the equations associated therewith will now be set out. For this, the impedances of each of the elements are determined.

The pressure drop through the nozzle 50 is described by the Navier Stokes equations. In the sinusoidal mode, the movement of the ink mass trapped in the nozzle is limited by the inertia terms. The nozzle impedance will be noted $Z_b$:

$$Zb = i\omega\frac{\rho L_{nozzle}}{S_b}$$

with:

$L_{nozzle}$: nozzle length $S_b$: nozzle cross-section area

ρ: ink density

ω: angular frequency at the operating frequency.

The ink wedge 520 under the actuator concerns the column at the input of the nozzle (this column is located in the removable nozzle plate but before the zone 521 which connects it to the nozzle 50), and the ink "disk" located under the active face of the actuator. For the column, the diameter is for example 500 μm, to be compared with the nozzle diameter, once again taken by way of example, of 50 μm. The ink velocity in the wedge is thus very low (factor 100) compared with the nozzle. The fluid can thus be considered as immobile (no inertia effect). The wedge impedance is thus only its compressibility term noted $Z_c$:

$$Z_c = \frac{Ke}{i\omega Ve}$$

where Ke is the compressibility and Ve the ink volume of the zone 521.

The waveguide 550 is an acoustic element delimited by the active face of the resonator; it rises up to the level of the shoulder 53 against which the resonator bears. This zone being flowed with liquid, the liquid ring is thus considered between the resonator and the sheath of the stimulation body.

It is reminded that the liquid column has section variations, the impedance of this column, per segment, is given by the formula of the line theory (in electrical analogy):

$$Z_{BC} = \frac{Z_{AB}\cos(kL_B) + iZ_B\sin(kL_B)}{\cos(kL_B) + i\frac{Z_{AB}}{Z_B}\sin(kL_B)}$$

where $Z_{BC}$ is the equivalent impedance at an input of the segment AB with an acoustic impedance $Z_b$ terminated by a charge impedance $Z_{AB}$.

The piezoelectric actuator has in turn a resonating behaviour that can be modelled by the localised constant approximation (mass-spring analogy). In view of impedances relating to the actuator with respect to the fluid, the actuator is dominating: in the first order, the resonance frequency of the stimulation assembly is set to the resonance of the ½ Langevin (the resonator) in air.

Since the operating frequency is fixed (83.3 KHz), this mechanical resonance will not be considered, for the model to be more legible. The resonating assembly is thus assimilated to a flow rate source, this is the ink volume agitated at the end of the resonator: Q.

The unit impedance terms are defined for the outflow rate, thereby it is possible to determine the pressure P at the end of the bar. The pressure drop in the nozzle equivalent to its impedance $Z_{nozzle}$ gives the flow rate as a function of the frequency or even the jet velocity modulation for a given nozzle section.

Figure 10A:
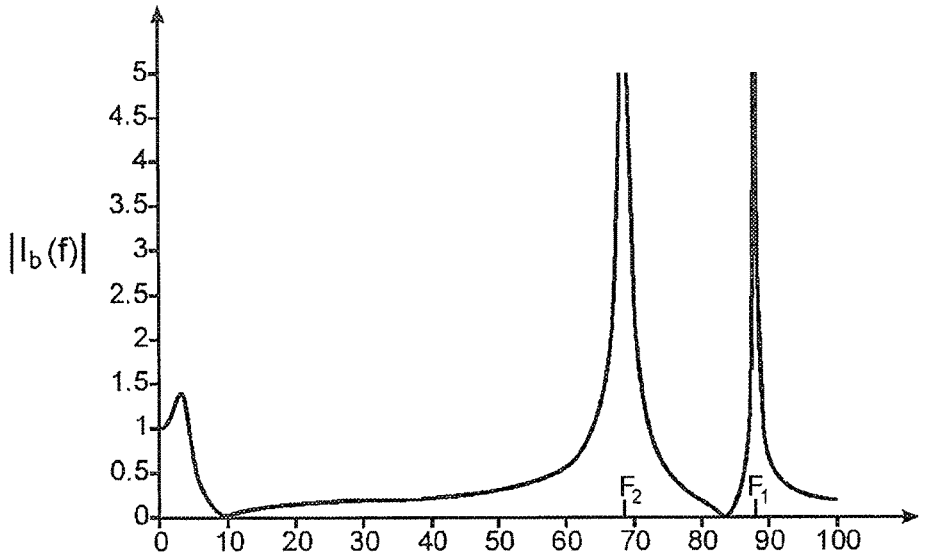
FIG. 10A-10B represent the frequency response of a stimulation body for 2 different ink temperatures.

The previous formulae have enabled the curve (FIG. 10A) of the frequency response at a temperature of 5° C. to be drawn, that is the module of the jet velocity modulation as a function of the frequency. The velocity unit is normalised, which enables the frequencies for which the stimulation is enhanced (resonance phenomenon) or weakened (transmission zero, anti-resonance) to be relatively located.

It is noticed in this Fig. that, in the frequency range of interest, that is 80-90 KHz, there are two noticeable frequencies F1 and F2 which will have an influence on the efficiency level of the stimulation at 83.3 KHz. This frequency overall space does not rise any problem if these frequencies are stable in the operating environment of the printer; at most, the stimulation level can be different from one printer to the other.

But these frequencies F1, F2 change as a function of temperature which seems to be the parameter disturbing the sturdiness for stimulation. Simulations with "MathCad" software enable the ink velocity as a strongly influencing parameter to be identified. At room temperature (see Handbooks of Physics 1990-1991—$71^{th}$ edition—pages 14-32 and the velocity measurements in actual inks of curve of FIG. 16), the ink velocity typically ranges from −3 to −4 m/s per ° C.

Figure 10B:
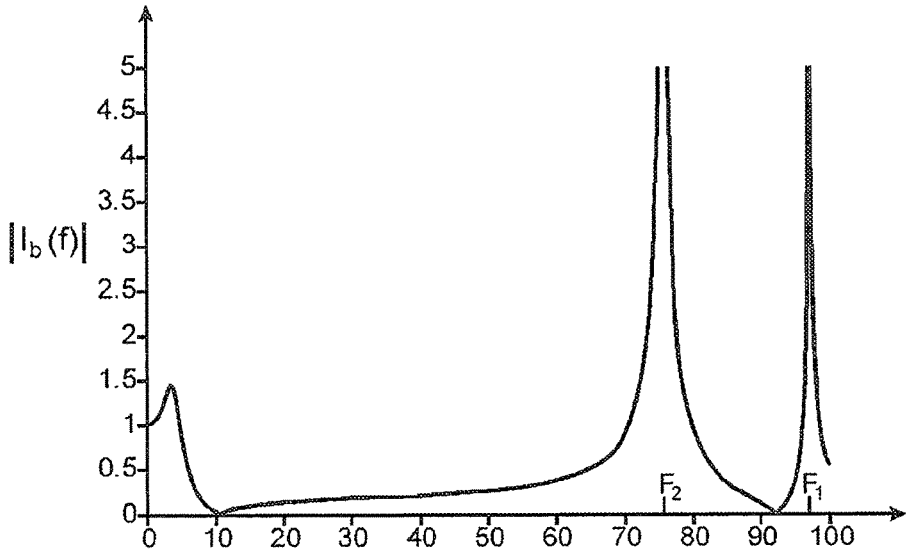

The same simulation has been made on a temperature range of 45° C., as experimentally explored, which enabled a frequency offset of F1, F2 of about 10 KHz to be emphasised (FIG. 10B). The sign of the velocity dependence as a function of temperature is high since the temperature sliding makes the frequency F2 troublesome, whereas F1 exits from the operating frequency zone.

This frequency offset can seem to be low enough; however, when combined to the proximity of F1 and F2 about 83.3 KHz, it is understood that it is possible to have high variations in the stimulation levels when F2 intersects the operating frequency.

The tests reported above have enabled an acoustic resonance phenomenon to be emphasised within the fluid cavity. This phenomenon is depending on the propagation velocity of the acoustic waves within the ink; a dependence, as a function of temperature, thus appears, which positions the events, in frequency, closer or less close to the operating frequency.

Complementary results (actual measurements) have been made, with the same type of stimulation tunings. These measurements implement a stimulation body identical to the previous simulated situation, with the following settings: the results are shown in FIG. 11.

For these measurements, with a low voltage (low stimulation), the measurement of the break length Lb during a frequency scanning has been made, at different temperatures (5° C.-45° C.), in order to view the events on the 70-100 KHz range. The break length Lb is measured. These measurements are made on the temperature range from 5° C. to 45° C., with a 10° C. pitch, using the following parameters:

- white pigmented MEK based ink,
- jet velocity: 20 m/s
- stimulation signal (50% duty factor slot) generated by a laboratory apparatus,
- standard stimulation body (with the structure of FIG. 5D) equipped with a piezoelectric actuator the resonance frequency of which is close to the operating frequency (which is the drop generating frequency).

Figure 11:
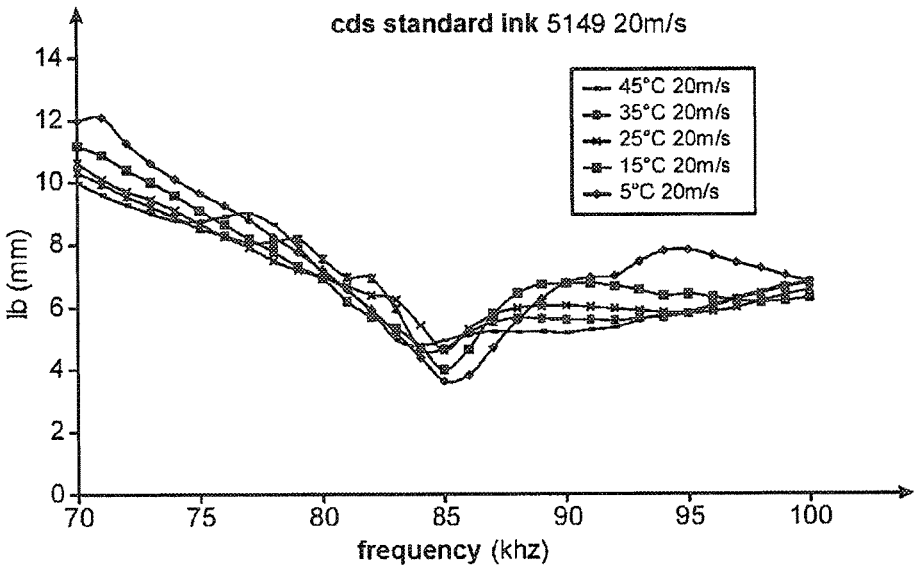
FIG. 11 represents other complementary results.

The results illustrated in FIG. 11 show many events about the operating frequency 83.3 KHz. The curves are intersected as a function of temperature and the absolute minimum of break length significantly drifts as a function of temperature. This operation degrades the stimulation sturdiness.

These complementary results confirm the disturbances observed and already reported above. On the other hand, they illustrate the difficulty, or even the impossibility, to maintain a stable operation of a drop generating device at at least 2 positive temperatures distant by about at least 15° C. or 20° C., for example on the one hand by 5° C. and/or 15° C. and, on the other hand, by 30° C. and/or 35° C. and/or 45° C., more generally in a temperature range ranging on the one hand from 5° C. or 15° C. to, on the other hand, 35° C. or 45° C. or even 50° C.

Other works have confirmed the hypothesis of the influence of the disturbances related to the resonances present in the fluid cavity. Actual measurements have been made on a drop generator with a head G the mechanical simplicity of which (cavity and resonator bar are thus cylindrical, of the type as in FIG. 5A) enables the resonating behaviour of the fluid cavity to be more readily calculated.

Complementary tests have thus been conducted for a stimulation body of the type of that of FIG. 5A.

More precisely, the break length has been investigated, as a function of the frequency, in low stimulation, for 3 different temperatures. Since the stimulation voltage is 7 Volts, it enables always to have a "slow" satellite and thus, according to the linear theory of capillary instability, the break length to be directly related to the stimulation efficiency.

The temperatures tested were 5° C., 25° C., and 45° C.

The ink used is a pressurised white pigmented MEK-based ink to reach a constant jet velocity of 20 m/s. The tests have not been made at a constant wavelength; hence, the jet velocity is not readjusted as a function of frequency, and a parabolic type envelope is obtained, which reflects the physical capillary instability phenomenon which will be taken into account in exploiting the results.

In FIG. 12A-C, the points from the measurement of Lb have been represented, as well as the resonance and anti-resonance frequencies in the cavity, which are numerically calculated from the mechanical configuration of the generator and the sound velocities in the ink at the different temperatures. The transmission zeros (anti-resonance) are identified by vertical bars. The peaks Pc (FIGS. 12A and B), or $Pc_1$, $Pc_2$ (FIG. 12C) represent the resonance peaks in the liquid.

For 5° C. (FIG. 12A):

The theoretical model has been adjusted with a velocity in the ink c=1 170 m/s. The resonance frequency of the actuator is about 64 kHz. The model further gives 2 transmission zeros, corresponding to 46 kHz and 74 kHz. For 46 kHz, the efficiency decrease associated is being found again; but, for 74 kHz, it has not been possible to read out the values, since the break is in the «noise» of the natural break.

The model also predicts a resonance peak at approximately 57 kHz remarkably observed on the curve of break length. The resonance phenomenon at 64 kHz is also emphasised, it is prevailing in terms of amplitude because it is imposed by the actuator.

For 25° C. FIG. 12B):

The theoretical model has been adjusted with c=1 100 m/s, that is a slope of −3.5 m/s/° C. Both transmission zeros are located at about 42 kHz and 69 kHz. This is well confirmed by the experimental data which result, at these frequencies, in a stimulation sub-efficiency. An acoustic resonance in the ink cavity is also well emphasised at about 53 KHz. The actuator resonance is also well visible, but the resolution is not sufficient to accurately locate this break length minimum which is probably between 63 kHz and 64 kHz.

For 50° C. FIG. 12C):

The theoretical model has been adjusted with c=1 030 m/s, that is a slope of −3.5 m/s/° C. The first zero is found slightly before 40 kHz and the second at 65 kHz. The latter is very close to the operating frequency and thus comes to be superimposed with the resonance peak of the actuator located at 64 kHz.

To solve the abnormalities observed above, it is suggested to adjust the acoustic impedance of the system, more particularly that of the fluid cavity, in the proximity of the nozzle 10.

This acoustic impedance varies as a function of frequency, in particular, when this varies about the operating frequency.

Figure 13A:
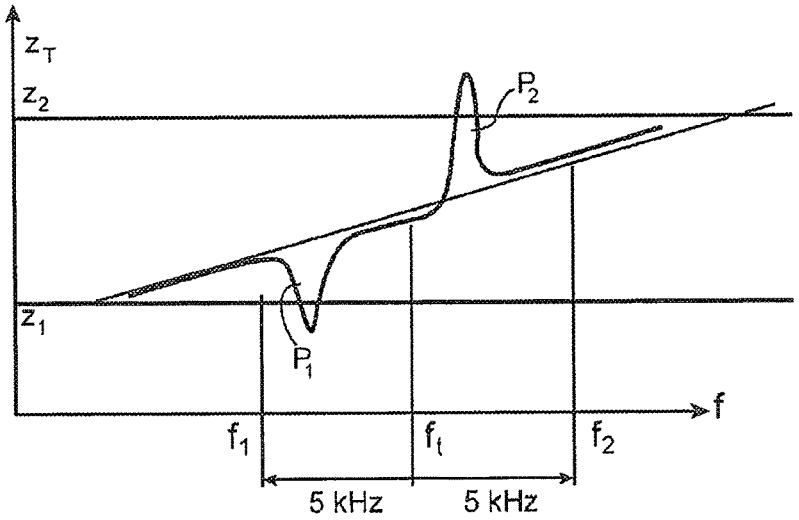
FIG. 13A represents the time change in the acoustic impedance as a function of the frequency and FIG. 13B represents the time change in the modulation of the jet velocity as a function of the frequency.

In FIG. 13A, is represented the typical time change in this acoustic impedance (in proximity of or at the nozzle 10), as a function of the frequency and for a given temperature. The operating frequency of the system (in order words: of the cavity and the actuator) is identified by $f_t$ and the value of said acoustic impedance at this operating frequency is designated as $Z_T(f_t)$. This operating frequency is defined by the cavity and by the resonator in the case of FIG. 5A-5D. In the case of FIG. 5E, it is defined by the geometry of the stainless steel cylinder 32.

As seen in FIG. 13A, the acoustic impedance varies evenly or smoothly about $f_t$. But, when disturbances, of the type explained above, appear, one or more peaks $P_1$, $P_2$, of resonance or anti-resonance, appear on this graph, in particular in the vicinity of the operating frequency, for example in an interval of ±10 kHz or ±5 kHz about the latter.

This impedance variation results in varying the amplitude of the jet velocity modulation (or even the stimulation efficiency) in the nozzle and thus the break length.

Further, the graph of FIG. 13A changes as a function of temperature. Peaks such as peaks p1, p2, not present in the frequency interval searched for, at a certain temperature, for example at 5° C. or at 15° C., can appear, in the same frequency interval, at another temperature, for example at 30° C. or at 35° C.

According to the invention, a frequency range $[f_1, f_2]$, of ±10 kHz or ±5 KHz, about the operating frequency $f_t$ is defined. The system is such that, when the frequency varies in this range, the value of the velocity modulation in the nozzle at a temperature T, with respect to the velocity modulation in the nozzle at 25° C., does not vary outside an interval between, on the one hand, 0.25 (or 0.5) and, on the other hand, 2 (or even 4), and that at, on the one hand, 15° C. and, on the other hand, at 35° C., preferably also at 5° C., and/or 10° C. and/or 20° C., further preferably also at 45° C. or even 50° C., further preferably at any temperature included in a temperature range ranging from at least 15° C. (or 10° C. or 5° C.) to at least 35° C. (or to 40° C. or to 45° C. or to 50° C.). An example of this interval of velocity modulation is represented by horizontal bold lines in FIG. 13B. Thus, there are avoided:

- on the one hand the presence, in an interval close to $f_t$, of peaks (such as P'1 and P'2 in FIG. 13B) reflecting disturbances;
- on the other hand, a drift in such peaks, to $f_t$, as a function of temperature.

It is noted that the impedance can be calculated according to the already above mentioned formula. From this calculation, the jet velocity modulation and its variations under the effect of temperature can be deduced.

This velocity modulation can thus be estimated or deduced from the measurement of the variations in $L_b$ (the formula of which has moreover been given above) as a function of frequency, at a constant excitation voltage. Indeed, a variation in $L_b$ reflects a variation in impedance.

Alternatively, it is possible to measure or estimate the variations in pressure, as a function of frequency. At the nozzle 10, these variations in pressure represent or reflect variations in $L_b$ as well as variations in acoustic impedance (i.e. jet velocity modulation).

The solution provided above can be achieved by modifying the configuration of the internal volume of the stimulation body, intended to receive ink, giving it a shape enabling a variation in acoustic impedance to be made.

In other words, the internal volume includes at least one first part, having a first acoustic impedance, and at least one second part, having a second acoustic impedance, different from the first acoustic impedance.

For example, in the cavities, one element, or means, can be introduced, enabling this variation in impedance to be made. The embodiments of this solution are represented in FIG. 14A-14E.

Figure 14A:
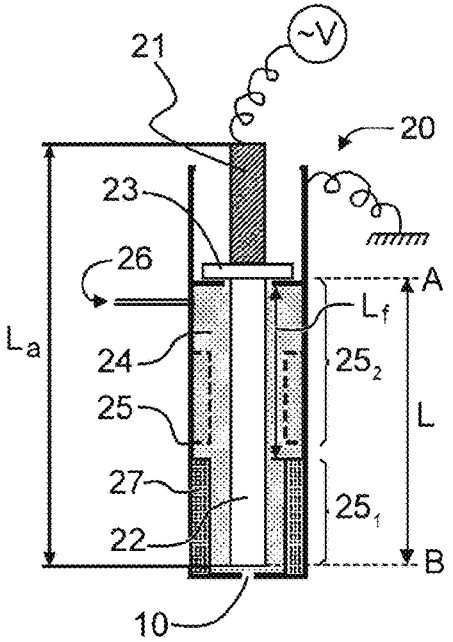
FIG. 14A-E represent structures of stimulation bodies implementing the invention.
Figure 14B:
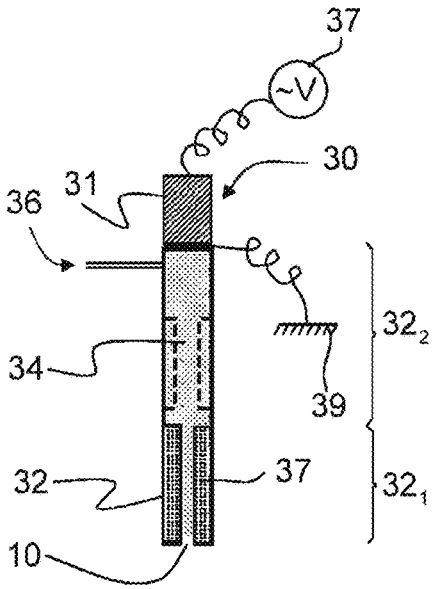
Figure 14C:
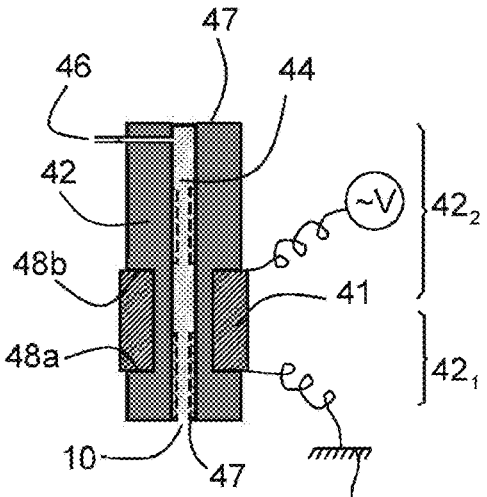

The device of FIG. 14A (respectively 14B, 14C, 14D, 14E) corresponds to that of FIG. 5A (respectively 5B, 5C, 5D, 5E), the same reference numerals designating the same elements. In each of these FIG. 14, an annular shaped ring 27, 37, 47, 57, has been introduced in the internal volume of the cavity. The external diameter of this ring is substantially equal to the internal diameter of the envelopes 25, 32, 42, whereas its internal diameter does not obstruct fluid flow. The material for this ring is preferably the same as that of the resonator, for example stainless steel.

In these Fig, the ring is represented in the lower part of the cavity. Alternatively, it could be disposed in another part, for example according to the arrangement represented in dashed lines on each of these Fig. Thereby, it would have the same role of modifying the acoustic impedance of the cavity.

More generally, it is also noticed, on these Fig, that the internal shape of the cavity includes:

- a first cylindrical zone $\mathbf{25}_1$, $\mathbf{32}_1$, $\mathbf{42}_1$, $\mathbf{52}_1$, $\mathbf{62}_1$ of a first diameter, and a first length, measured along a longitudinal axis of said cavity,
- a second cylindrical zone $\mathbf{25}_2$, $\mathbf{32}_2$, $\mathbf{42}_2$, $\mathbf{52}_2$, $\mathbf{62}_2$, of a second diameter, different from the first diameter, and a second length, measured along a longitudinal axis of said cavity.

In the case where the ring of each of FIG. 14 is positioned according to the position indicated in dashed lines, the first cylindrical zone and the second cylindrical zone are different from those mentioned above.

As will be shown below, differences, or variations, in acoustic impedance, induced, in the examples of FIG. 14, by the different diameters in the cavity, enable the parasitic frequencies which result from the resonances unique to the cavity containing the liquid to be removed from the zone of the operating frequency, and thus the velocity modulation to be stabilised.

Figure 14D:
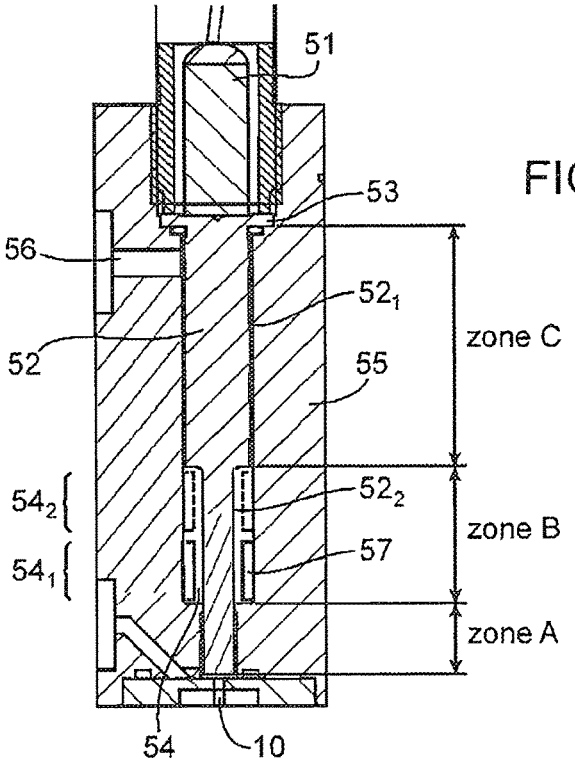
Figure 14E:
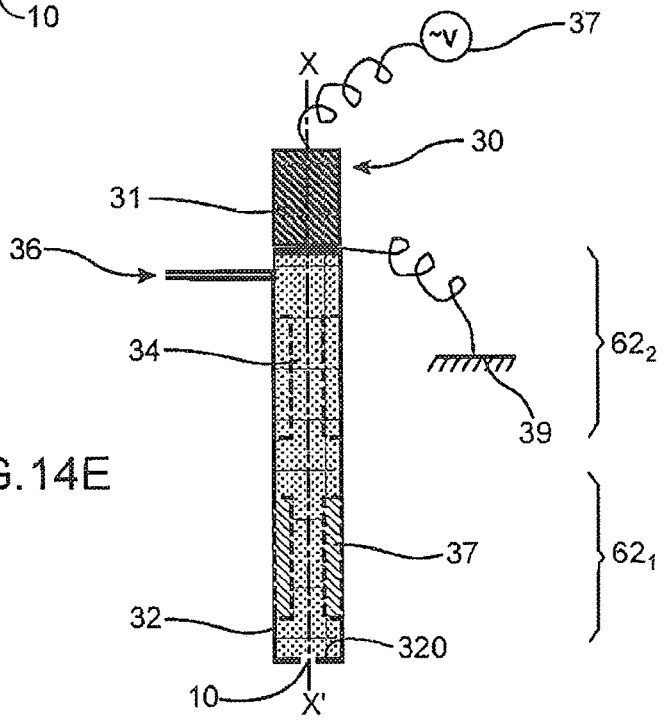

The different diameters enable a variation in the fluid length to be made. In the case of the structures of FIGS. 14A and 14D, in which the resonator dips into the cavity intended to accommodate the fluid, a ratio between the length $L_a$ of the mechanical actuator (including the piezoelectric element 21, 51, the flange 23, 53 and the part 22, 52, which is in contact with the fluid) and the length $L_f$ of the, or a, portion of the cavity intended to accommodate a fluid column, preferably strictly higher than 4, is created; this ratio can for example be included between 4 and 6 or 4 and 10 or 100. In the case of FIG. 14D, the length $L_f$ corresponds to the length of the portion of the zone B not occupied by the ring 57. Even if a fluid column remains, the length of which is not modified by the presence of the ring, the modification in the length of a part of the cavity, intended to accommodate the fluid, enables the parasitic frequencies to be removed, from the zone of the operating frequency.

Figure 15A:
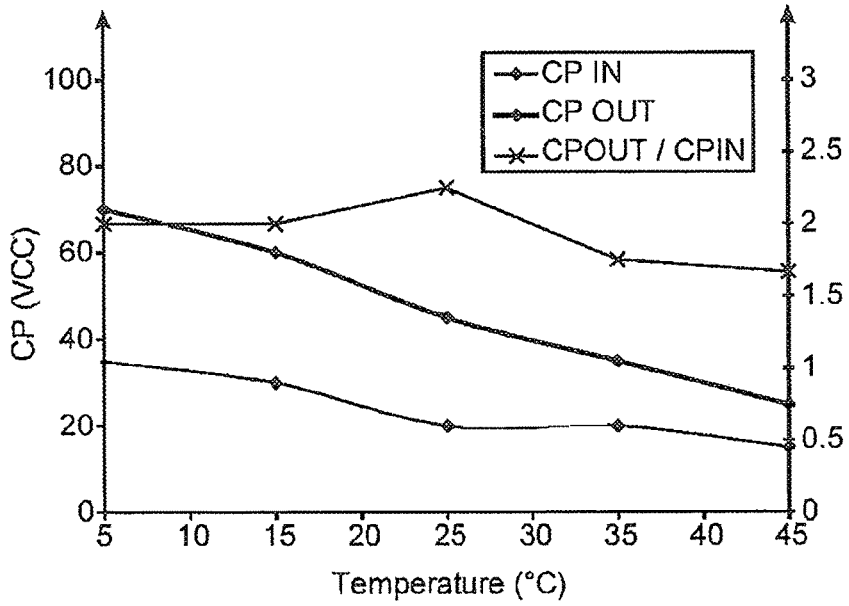
FIG. 15A-15C represent test results obtained with a stimulation body with the invention, FIG. 16 gathers ultrasound velocity data for different inks, as a function of temperature.
Figure 15B:
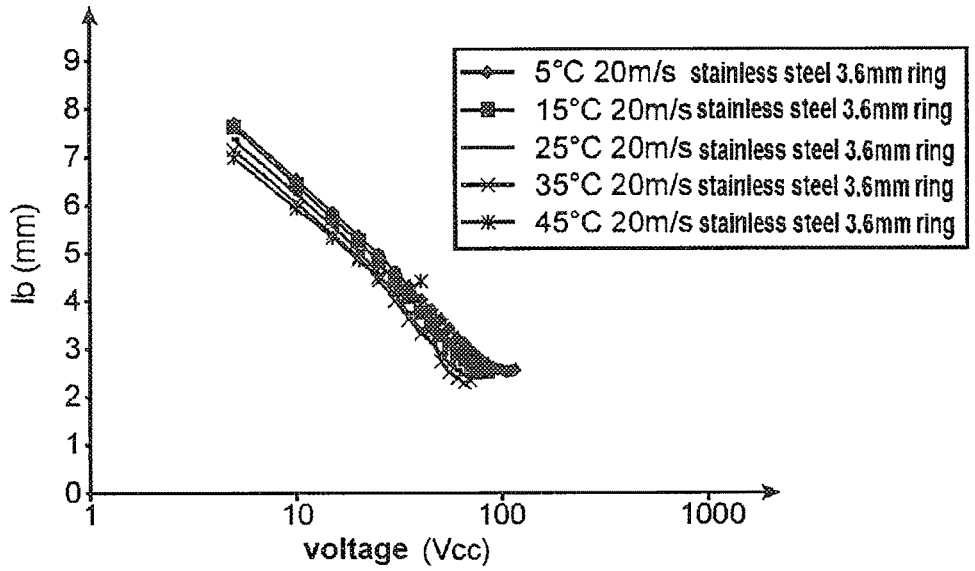
Figure 15C:
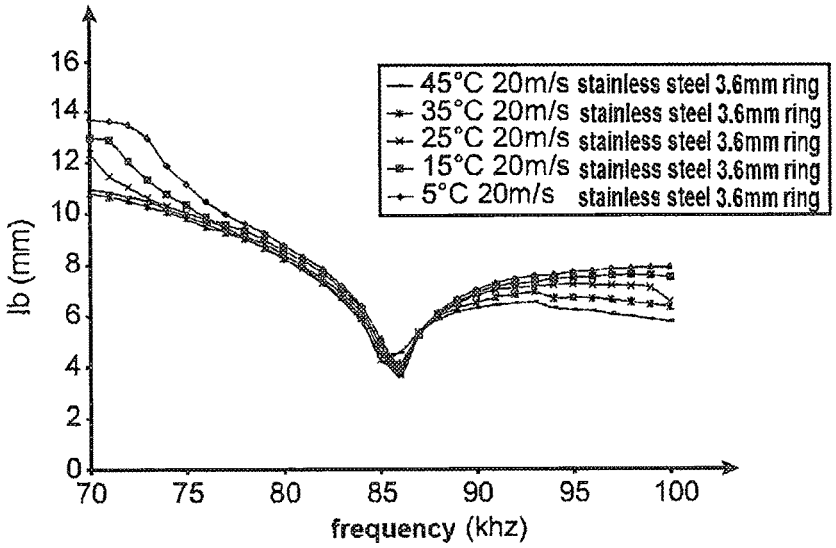

Tests have been made, with a structure of stimulation body according to FIG. 14D, with a ring the length of which, at the end the investigation, was 3.6 mm. The results are illustrated in FIG. 15A-15C:

- FIG. 15A represents the time change in the voltages Ve, Vs, Vr and the ratio Vs/Ve, as a function of temperature; this FIG. 15A shows that there is a nearly linear variation in the piezoelectric set points. It is thus very advantageously compared with the results which have been discussed above in connection with FIG. 7A;
- FIG. 15B represents the break length $L_b$, as a function of the activation voltage, at different temperatures (5° C.-45° C., with a pitch of 10° C., at 5° C., 15° C., 25° C., 35° C., 45° C.); it is noticed that the curves are properly stacked, in a right order; once again, the comparison with the curves of FIG. 7B is very advantageous,
- FIG. 15C represents the break length $L_b$, as a function of frequency, at different temperatures (5° C.-45° C., with a pitch of 10° C., to 5° C., 15° C., 25° C., 35° C., 45° C.); the curves are properly stacked, in a right order as a function of temperature, and do not intersect each other. This result is much higher than that observed in FIG. 11 where the order is wrong and the curves intersect each other.

Complementary tests have been made with a "standard MEK based" type ink and then with an "alcohol-based" type ink. The results obtained are similar to the 2 previous inks and confirm the optimum character of the 3.6 mm ring.

The presence of the ring enables the volume of the ink cavity to be decreased which facilitates the rinsing of the drop generator during maintenance operations.

The tests above show that the invention enables a sturdy operation to be achieved throughout the temperature and ink range contemplated (through the velocity). The invention enables any disturbing event on stimulation efficiency to be removed. A sharp improvement is noted on most of the curves obtained, that is a random operation is switched to a well-controlled operation.

The embodiment of the invention with the insertion of a ring into the cavity of the modulation body can be replaced by directly machining the ring function in the modulation body which therefore becomes a single piece and which has variations in cross-section area, thus having a profile identical or similar to what has been represented in FIG. 14A-14E.

According to another embodiment, the differences in sound wave velocities in various materials other than stainless steel are exploited. The stainless steel material used is then replaced for the resonator with one of these other materials.

Figure 13B:
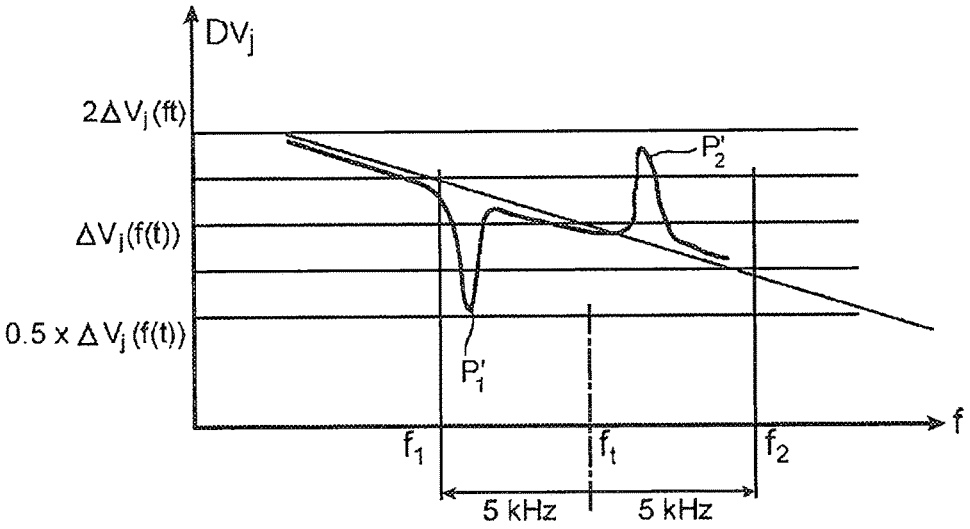

This solution enables conditions set forth above in connection with FIG. 13B to be met.

This solution also enables the resonator length to be modified while keeping the same operation frequency. The choice of another material is accompanied with a modification in the resonator length which, in the first place is proportional to the velocity ratio.

If the velocity is greater than in stainless steel, the bar (case of FIGS. 5A and 5D or 14A and 14D) under the flange of the resonator will be extended; conversely, if the velocity is lower, the bar under the flange will be shortened. The length of the resonating cavity containing the fluid could thus be modified, for example according to the previous teaching according to the present invention:

the jet velocity modulation, from the nozzle, having a value $\Delta Vj(f_t)$ at the operating frequency of the cavity and the actuator, and this jet velocity modulation, at the temperature of 15° C. and at the temperature of 35° C., does not vary, in a frequency range of ±5 KHz about the operating frequency $f_t$, outside the interval between $0.25\Delta Vj(f_t)$ and $4\Delta Vj(f_t)$;

and/or the ratio of the mechanical actuator length to the length of the, or a, portion of the cavity intended to accommodate a fluid column, being strictly higher than 4; this ratio can for example be between 4 and 6 or 4 and 10 or 100.

In this case, the resonance and anti-resonance frequencies of the fluid cavity will be displaced and rejected outside the stimulation operating zone.

Table I gathers data related to the sound wave velocity in these other materials.

TABLE I

| Material | Velocity (m/s) | Velocity (ft/s) |
|---|---|---|
| Aluminium | 6 420 | 21 063 |
| Beryllium | 12 890 | 42 530 |
| Brass | 3 475 | 11 400 |
| Copper | 4 600 | 15 180 |
| Diamond | 12 000 | 39 400 |
| Glass | 3 962 | 13 000 |
| Pyrex glass | 5 640 | 18 500 |
| Gold | 3 240 | 10 630 |
| Iron | 5 130 | 16 830 |
| Lead | 1 158 | 3 800 |
| Lucite | 2 680 | 8 790 |
| Silver | 3 650 | 12 045 |
| Steel | 6 100 | 20 000 |
| Stainless steel | 5 790 | 19 107 |
| Titanium | 6 070 | 20 031 |

If one of these other materials is retained for the resonator bar, then the disturbance effects of the sound waves in the ink will not be exhibited.

More generally, all the metal materials—other than stainless steel—or mineral materials can be suitable.

This choice further enables the length of the resonator, and thus the cavity length to be possibly reduced, which enables, furthermore, the parasitic resonances as set forth above to be avoided.

Regardless of whether the structure of the stimulation body is that of one of the FIG. 5A-5D or 14A-14D, the disturbance effects due to the resonance in the cavity containing ink will not occur.

Figure 1:
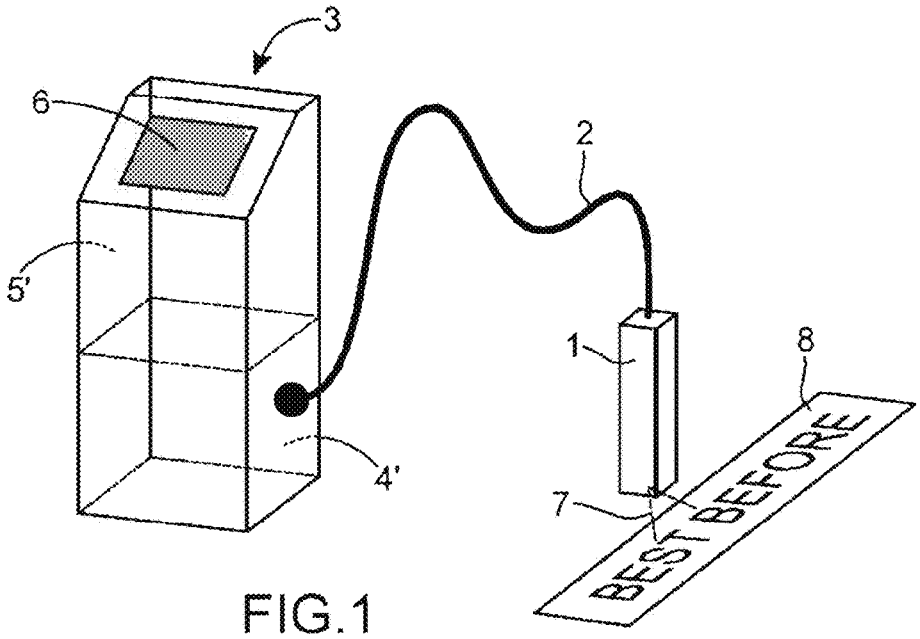
FIG. 1 is a scheme of the structure of a deviated continuous jet printer.
Figure 2:
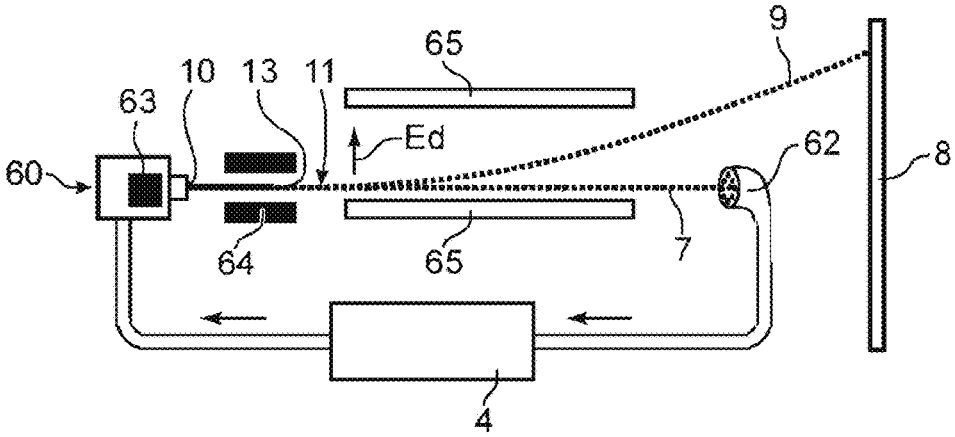
FIG. 2 is a scheme of a printing head of a deviated continuous jet printer.

An ink jet device or printer for implementing a method for forming ink drops, with a device according to one of the embodiments detailed above, is of the type that has already been described in connection with FIGS. 1 and 2.

Such a device thus includes:

a drop generator 60 containing electrically conductive ink, held under pressure, by an ink circuit, and emitting at least one ink jet, a charging electrode 64 for each ink jet, the electrode having a slot through which the jet passes, an assembly consisting of two deflection plates 65 placed on either side of the jet trajectory and upstream of the charge electrode, a gutter 62 for recovering the jet ink not used for printing in order to be brought back to the ink circuit and thus be recycled.

The operation of this jet type has already been described above in connection with FIGS. 1 and 2. It will be simply reminded here that the ink contained in the drop generator escapes from at least one gauged nozzle 10 thus forming at least one ink jet. Under the action of a periodical stimulation device placed upstream of the nozzle (not represented), consisting for example of a piezoelectric ceramics placed in the ink, the ink jet is broken at regular time intervals, corresponding to the period of the stimulation signal, at an accurate location of the jet upstream of the nozzle. This forced fragmentation of the ink jet is usually induced at a so-called "break" point 13 of the jet by the periodical vibrations of the stimulation device.

Figure 17:
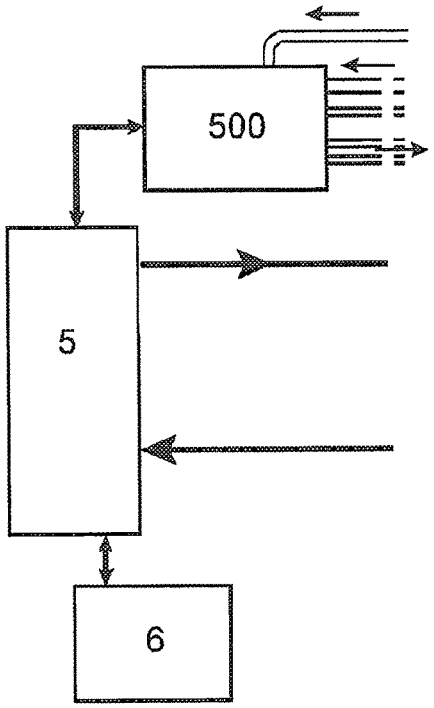
FIG. 17 is a schematic representation of the means for controlling an ink jet printer.

Besides the means above, such a device can further include means 5 for controlling and regulating the operation of each of these means taken alone, and the voltages applied. These means 5 are described below more precisely in connection with FIG. 17.

In this Fig., an assembly of controller means 5 includes circuits, which enable the voltages for driving the printing head to be sent to the same and in particular the voltages to be applied to the electrodes as well as the piezoelectric excitation voltage.

This assembly 5 can further receive downlink signals, from the head, in particular the signals measured using a position and/or drop velocity sensor, and can process them and use them for controlling the head and the ink circuit. In particular, for processing the signals from such a sensor, it can include means for analogically amplifying this signal from this sensor, means for digitising this signal (A/D conversion transforming the signal into a list of digital samples), means for de-noising it (for example one or more digital filters for the samples), means for searching the maximum thereof (the maximum of the list of samples).

This controller assembly 5 can communicate with means 500 for sending and/for receiving fluids to and from the printing head.

This controller assembly 5 can communicate with the user interface 6 to inform a user about the printer state and the measurements performed, in particular of, the type of those described below. It includes storage means for storing instructions relating to data processing, for example for carrying out a method or carrying out an algorithm of the type described above.

According to an exemplary embodiment, the controller 5 includes an embedded central processing unit, which itself comprises a microprocessor, a set of non-volatile memories and RAM, peripheral circuits, all these elements being coupled to a bus. Data can be stored in the memory zones, in particular data for implementing a method according to the present invention or for controlling a device according to the present invention.

The means 6 enable a user to interact with a printer according to the invention, for example by performing the configuration of the printer to adapt its operation to requirements of the production line (rate, printing velocity, . . . ) and more generally of its environment, and/or the preparation of a production session for determining, in particular, the printing content to make on the products of the production line, and/or by displaying information in real time for the follow-up of production (state of consumables, number of labelled products, . . . ). These means 6 can include viewing means.

Means can further be provided for supplying or bringing the different electrodes to the desired voltages. These means include in particular voltage sources.

A stimulation body according to the invention, and a method for operating a stimulation body according to the invention, as described above, applied to a printer of the type described in connection with FIGS. 1 and 2, the operation of which has been reminded above, enable a sturdy stimulation to be made, which does not have the problems shown in the introduction to the present application in connection with known devices. In particular, the stimulation is much more stable, at at least 2 temperatures distant by at least 15° C. or more, in particular 15° C. and 30° C. (or 35° C.), preferably also 5° C., and/or 10° C. and/or 20° C., further preferably 40° C. or 45° C. or even 50° C., further preferably at any temperature in a range between 15° and 35° and more generally between 5° and 50° C.

With a device and a method according to the invention, the "parasitic" frequencies are discarded, regardless of the temperature in any of the ranges discussed above, from the operating frequency range used. For example, this operating range is between 50 KHz and 150 KHz depending on the diameter and jet velocity chosen.

The invention claimed is:

1. A device for forming and ejecting drops of an ink jet of a CIJ printing machine, this device including:

a cavity for containing an ink and including an end provided with a nozzle for ejecting ink drops, and a resonator, in contact with the cavity, made of a material chosen from aluminum, beryllium, brass, copper, diamond, glass, gold, iron, lead, TMMA, silver, and titanium, wherein the resonator is configured such that a velocity of sound waves in the resonator does not equal the velocity of sound waves in a resonator made of stainless steel.

2. The device according to claim 1, said resonator including a piezoelectric element.

3. The device according to claim 1, said resonator including a resonator body disposed in said cavity.

4. The device according to claim 3, said resonator body including a first part having a first diameter and a second part having a second diameter, different from the first one.

5. The device according to claim 1, the internal volume of the cavity being delimited by a resonator wall.

6. The device according to claim 1, said resonator including a flange and a bar extending below the flange, wherein a length of the bar is longer as compared to a resonator made from stainless steel when the velocity of the sound waves in the resonator is greater than the velocity of the sound waves in the resonator made of stainless steel, when an operation frequency of said resonator equals an operation frequency of said resonator made from stainless steel, and wherein a length of the bar is shorter as compared to the resonator made from stainless steel when the velocity of the sound waves in the resonator is less than the velocity of the sound waves in the resonator made of stainless steel, when the operation frequency of said resonator equals the operation frequency of said resonator made from stainless steel.

7. The device according to claim 1, said resonator including a flange and a bar extending below the flange, wherein an operation frequency of the resonator is higher as compared to a resonator made from stainless steel when a length of the bar is equal to the length of the resonator made from stainless steel and the velocity of the sound waves in the resonator is greater than the velocity of the sound waves in the resonator made from stainless steel, and wherein the operation frequency of the resonator is lower as compared to the resonator made from stainless steel when the length of the bar is equal to the length of the resonator made from stainless steel and the velocity of the sound waves in the resonator is less than the velocity of the sound waves in the resonator made from stainless steel.

8. The device according to claim 1, wherein the resonator is part of an actuator and a ratio of a length of the actuator to a length of the cavity is greater than 4.

* * * * *